US011317712B2

(12) United States Patent
Tsai

(10) Patent No.: US 11,317,712 B2
(45) Date of Patent: May 3, 2022

(54) EASY FOLD LOCKING MECHANISMS

(71) Applicant: Medal Sports (Taiwan) Corporation, Taipei (TW)

(72) Inventor: Kevin Chunhao Tsai, Kaohsiung (TW)

(73) Assignee: Medal Sports (Taiwan) Corporation, Taipei (TW)

( * ) Notice: Subject to any disclaimer, the term of this patent is extended or adjusted under 35 U.S.C. 154(b) by 0 days.

(21) Appl. No.: 17/520,082

(22) Filed: Nov. 5, 2021

(65) Prior Publication Data

US 2022/0053924 A1 Feb. 24, 2022

Related U.S. Application Data

(60) Continuation of application No. 17/031,957, filed on Sep. 25, 2020, which is a division of application No. 16/270,384, filed on Feb. 7, 2019, now Pat. No. 10,813,447, which is a continuation-in-part of application No. 15/152,752, filed on May 12, 2016, now Pat. No. 10,201,736.

(51) Int. Cl.

| | |
|---|---|
| ***A47B 3/091*** | (2006.01) |
| ***A63F 7/06*** | (2006.01) |
| ***A47B 37/00*** | (2006.01) |
| ***A47B 3/08*** | (2006.01) |
| ***A47B 25/00*** | (2006.01) |

(52) U.S. Cl.
CPC ..... *A47B 3/0913* (2013.01); *A47B 3/0818* (2013.01); *A47B 3/0912* (2013.01); *A47B 25/00* (2013.01); *A47B 37/00* (2013.01); *A63F 7/0612* (2013.01)

(58) Field of Classification Search
CPC ..... A47B 3/0818; A47B 37/00; A63F 7/0612
See application file for complete search history.

(56) References Cited

U.S. PATENT DOCUMENTS 3,072,451 A * 1/1963 Greenberg ..... A47B 3/0913 108/160
3,237,575 A * 3/1966 Larson ..... A47B 3/0912 108/125

* cited by examiner

*Primary Examiner* — Jeffrey S Vanderveen
(74) *Attorney, Agent, or Firm* — Dickinson Wright, PLLC; Michael E. Noe, Jr.

(57) ABSTRACT

The present disclosure relates to a support system for a gaming table including a first support bar of a gaming-table support, a second support bar of a gaming-table support, a third support bar of a gaming-table support, and a gaming-table support locking apparatus. The third support bar has an arcuate shape and is in a pivotable connection with the second support bar. The gaming-table support locking apparatus includes a first locking bar and a second locking bar. The second locking bar is configured to be in one of two states of being: a first state that allows the third support bar to rotate with respect to the second support bar; and a second state that prevents the third support bar to rotate with respect to the second support bar.

13 Claims, 17 Drawing Sheets

EASY FOLD LOCKING MECHANISMS

CROSS REFERENCE TO RELATED APPLICATIONS

This U.S. patent application is a Continuation of U.S. patent application Ser. No. 17/031,957, filed Sep. 25, 2020, which is a Divisional Application of U.S. patent application Ser. No. 16/270,384, filed on Feb. 7, 2019, now U.S. Pat. No. 10,813,447, which is a Continuation-in-Part of U.S. patent application Ser. No. 15/152,752, filed on May 12, 2016, now U.S. Pat. No. 10,201,736, the content of all of which is incorporated by reference herein in its entirety.

BACKGROUND

Traditional recreational basketball games (e.g., Pop-A-Shot®) often require a substantial amount of floor space for game play. While the backboard itself has a relatively flat profile (e.g., a flat wall with a rim), the side boundary nets and center return net extend far beyond the backboard. The center return net, specifically, must extend all the way to the user, such that made and missed basketballs are returned to the user. These nets often require structural support, such as poles and bars. Effective storage of the recreational basketball game, including these poles and bars, is an important concern. Ideally, recreational basketball games, and related structural supports, should be designed so that assembly and disassembly is efficient and easy for the user.

Assembly and disassembly of known basketball games may utilize locking mechanisms and, more particularly, quick-locking mechanisms to secure portions of the structure together. Quick-locking mechanisms such as snap clamps and spring-loaded devices allow structural components to be fastened to one another in an efficient manner. For example, snap clamps may employ a flexible fitting, which may be attached (i.e., snapped) and detached (i.e., unsnapped) from a rod or bar. The flexible fitting may be used to fasten multiple rods or bars together or, alternatively, to fasten other components (e.g., a tarp or cloth) to a rod or bar. Likewise, for example, spring-loaded devices may be retractable spring plungers. The body of the spring plunger may be disposed into a hole of a rod or bar, and spring-biased into the hole. By pulling on the spring plunger, the body of the spring plunger may be removed (i.e., retracted) from the hole for the particular rod or bar.

While being effective, quick-locking mechanisms are often not optimized for user interaction. Quick-locking mechanisms may require multiple components (e.g., a snap clamp requiring two individual rods and a flexible fitting). Additionally, many quick-locking mechanisms are designed for high-strength use. Materials selection regarding the quick-lock mechanisms, for example, may be driven by durability concerns; thus, metal-on-metal may be used. Likewise, quick-lock mechanisms may be spring loaded (e.g., retractable spring plungers) and thus have high force requirements for engagement and disengagement. These quick-lock mechanisms may not be ideal for in-home use because of high spring-force operations, pinch points could result in injury, etc. Concerns such as these become all the more relevant with products that will be used by single users and/or children.

SUMMARY

The present disclosure relates generally to an easy fold locking mechanism. More particularly, a gaming-table support locking apparatus is configured to enable a user to quickly assemble and disassemble structural components, such as the game apparatus, to/from storage-mode and play-mode. In storage-mode, the basketball game apparatus has a nearly flat profile, enhancing ease of storage.

In an example embodiment, a gaming-table support locking apparatus includes a first hinge bar, a second hinge bar, and a tab connector. The first hinge bar includes a first end configured to connect to a first bar of a gaming-table support and a second end including a tab notch. The second hinge bar includes a first end configured to connect to a second bar of the gaming-table support and a second end rotatably connected to the first hinge bar. The second hinge bar additionally includes a window located between the first end and the second end of the second hinge bar. The tab connector includes a base, a locking section, and a release section. The base is configured to connect to the second hinge bar at the window. The locking section has a first height to extend from the base through the window for engaging the tab notch to form a secure connection. The release section, connected to the locking section, has a second height, greater than the first height, to extend from the base through the window for receiving a force from a user. The release section is configured to be depressed toward the base causing the locking section to disengage from the tab notch.

In another example embodiment, a method of unlocking a gaming-table support locking apparatus includes disengaging a locking section of a tab connector. Disengaging the locking section of the tab connector includes inputting, by a user, a force on a release section of the tab connector. Disengaging the locking section of the tab connector additionally includes, responsive to receiving the force from the user, bending the tab connector about a fulcrum. The fulcrum is a rotatable connection between a first hinge bar and a second hinge bar, and a base of the tab connector is attached to the rotatable connection. Disengaging the locking section of the tab connector additionally includes depressing the release section of the tab connector towards the base of the tab connector, causing the locking section of the tab connector to disengage from a tab notch on the first hinge bar. The method of unlocking the gaming-table support locking apparatus further includes visually ensuring that the locking section of the tab connector has been disengaged from the tab notch on the first hinge bar. The method of unlocking the gaming-table support locking apparatus further includes rotating the second hinge bar, including the window, about the first hinge bar.

In yet another example embodiment, a gaming-table apparatus includes two side support panels and a backboard panel disposed between the two side support panels and including at least one hinged basketball rim. Each of the two side support panels includes a first bar of a gaming-table support, a second bar of a gaming-table support, and a gaming-table support locking apparatus. Each gaming-table support locking apparatus includes a first hinge bar including a first end configured to connect to the first bar of a gaming-table support and a second end including a tab notch. Each gaming-table support locking apparatus additionally includes a second hinge bar. The second hinge bar includes a first end configured to connect to the second bar of the gaming-table support and a second end rotatably connected to the first hinge bar. The second hinge bar additionally includes a window located between the first end and the second end of the second hinge bar. The second hinge bar additionally includes a tab connector having a base, a locking section, and a release section. The base is configured to connect to the second hinge bar at the window. The locking section has a first height extending from the base through the window for engaging the tab notch to form a secure connection. The release section is connected to the locking section and has a second height, greater than the first height, extending from the base through the window for receiving a force from a user. The release section is configured to be depressed toward the base causing the locking section to disengage from the tab notch.

Additional features and advantages of the disclosed method and apparatus are described in, and will be apparent from, the following Detailed Description and the Figures.

DETAILED DESCRIPTION

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
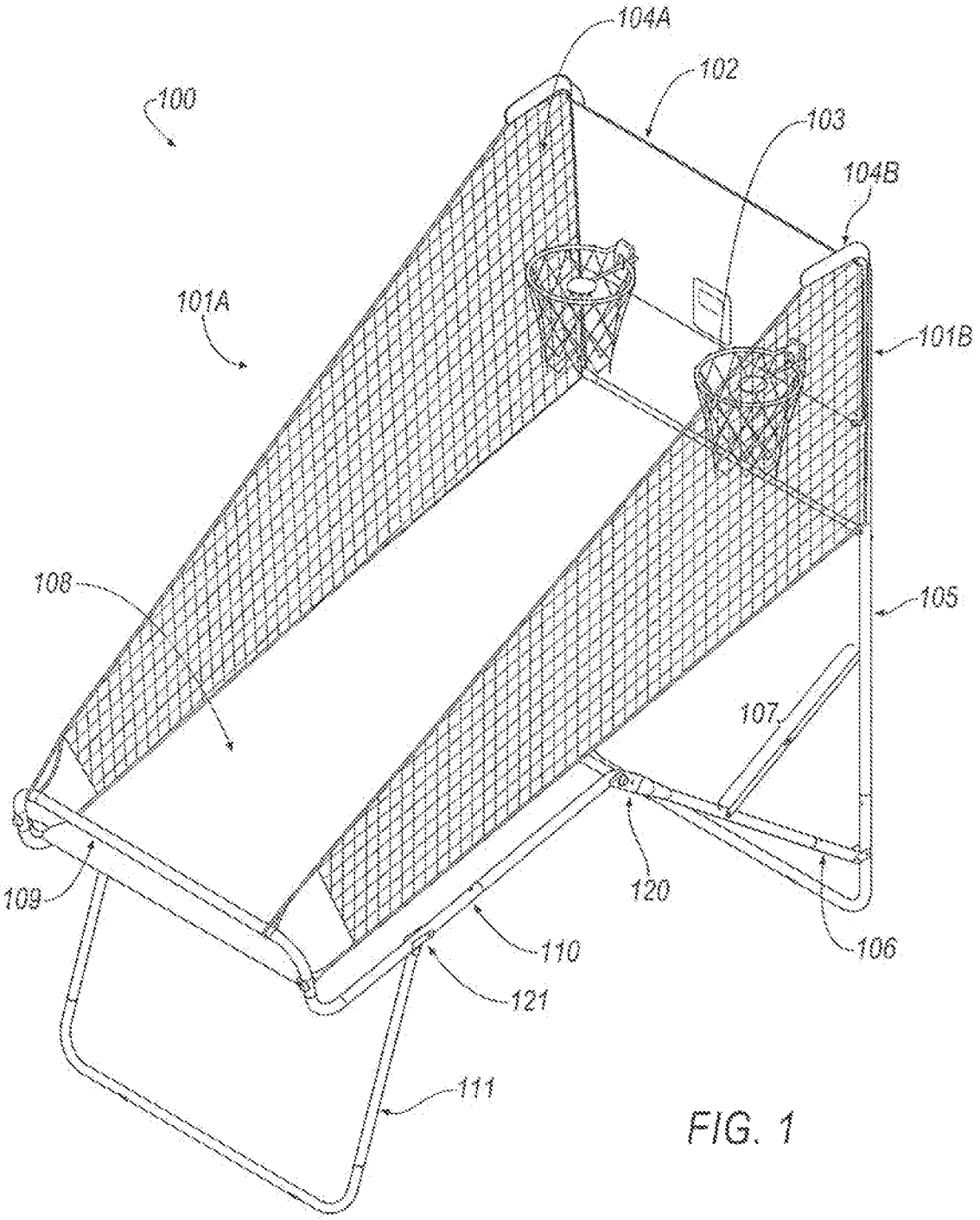
FIG. 1 shows a diagram of an example basketball game apparatus, according to an example embodiment of the present disclosure.

Referring now to the figures, FIG. 1 shows a diagram of an example basketball game apparatus 100, according to an example embodiment of the present disclosure. In an example embodiment, the basketball game apparatus 100 includes two side panels 101A-B and a backboard panel 102. In an example embodiment the two side panels 101A-B are mirror images of one another, such that each of the two side panels 101A-B includes the same structure and components. The backboard panel 102 additionally includes at least one basketball rim 103. In an example embodiment, the basketball rim 103 is hinged, such that it may fold flat and parallel with the backboard panel 102.

Each of the two side panels 101A-B of the basketball game apparatus 100 additionally includes a side boundary net 104A-B. Further, each of the two side panels 101A-B additionally includes a first bar of a gaming-table support 106 and a second bar of a gaming-table support 105. In other example embodiments, each side panel 101A and 101B may include additional bars of the gaming-table support (e.g., a third bar of the gaming-table support 110 and a fourth bar of the gaming-table support 111). Each of the first bar of the gaming-table support 106 and the second bar of the gaming-table support 105 are configured to support a portion of the basketball game apparatus 100 above the floor. For example, the first bar of the gaming-table support 106 and the second bar of the gaming-table support 105 may support a side boundary net (e.g., side boundary net 104A). Support may be enhanced by implementation of the additional bars of the gaming-table support (e.g., the third bar of the gaming-table support 110 and the fourth bar of the gaming-table support 111). Likewise, the second bar of the gaming-table support 105 supports a portion of the backboard panel 102. In an alternate example embodiment, only the second bar of the gaming-table support 105 supports the side boundary net (e.g., side boundary net 104A). In a different alternate example embodiment, both the first bar of the gaming-table support 106 and the second bar of the gaming-table support 105 are configured to support a portion of a center return net 108. Each of the two side panels 101A-B may additionally include at least one gaming-table support locking apparatus (e.g., gaming-table support locking apparatus 107). In other embodiments, each of the two side panels 101A-B may include multiple gaming-table support locking apparatus. In other embodiments, each of the two side panels 101A-B may include additional features such as hinges (e.g., first hinge 120 and second hinge 121).

In an example embodiment, the gaming-table support locking apparatus 107 may be disposed between the first bar of the gaming-table support 106 and the second bar of the gaming-table support 105. The gaming-table support locking apparatus 107 may be fixed to each of the first bar of the gaming-table support 106 and the second bar of the gaming-table support 105 by respective hinge bars, such as a first hinge bar and a second hinge bar. As used herein, each of the first hinge bar and the second hinge bar are configured to connect to a bar of the gaming-table support (e.g., the first bar of the gaming-table support 106). Likewise, each of the first hinge bar and the second hinge bar are configured to be rotatably connectable to one another, such that one of the hinge bars (e.g., the second hinge bar) may rotate with respect to another hinge bar (e.g., the first hinge bar). The first hinge bar and the second hinge bar are only two features of the gaming-table support locking apparatus 107; there are many other features.

The gaming-table support locking apparatus 107 may additionally include a window, a tab connector, and a tab notch each of which are described in greater detail below. The first hinge bar may include the tab notch. The second hinge bar may include the window, such as a hole, aperture, or geometric void. The tab connector may be connected to the second hinge bar at or near the window. The tab connector may extend through the window, such that it engages with the tab notch. This engagement, as described in greater detail below, especially with reference to FIGS. 4-8D, provides for locking, release, and rotation of the gaming-table support locking apparatus 107.

As disclosed herein, the gaming-table support locking apparatus 107 remedies the deficiencies associated with traditional quick-locking mechanisms. For example, the gaming-table support locking apparatus 107 is self-contained. It does not require a number of different components that could be lost or misplaced (e.g., a snap clamp with a flexible fitting and two rods or bars). Likewise, for example, the gaming-table support locking apparatus 107 is designed to require an ideal force (e.g., the pushing force from one finger of the user) for unlocking or release. It does not require the high-forces associated with many spring-loaded devices. The mechanical design of the gaming-table support locking apparatus 107 provides for secure connections in both locked and unlocked states.

Additionally, for example, the gaming-table support locking apparatus 107 provides for visual identification of the mechanism's condition (i.e., locked or unlocked). For example, the user may visually identify that the hinge bars on the gaming-table support locking apparatus 107 are aligned, and thus assume that the mechanism is in a locked condition; alternatively, if the hinge bars on the gaming-table support locking apparatus 107 are not aligned, the user may assume that the mechanism is in an unlocked condition. Likewise, for example, the user may visually identify a portion of the tab connector passing through the tab notch, and thus assume that the mechanism is in a locked condition; alternatively, if the tab connector does not pass through the tab notch, the user may assume that the mechanism is in an unlocked condition. The gaming-table support locking apparatus 107 performs each of these functions while optimizing additional constraints (e.g., materials selection) and minimizing the risk of injury (e.g., pinch point injuries). For example, by having the ability to visually identify when the mechanism is in an unlocked condition, the user is less likely to injure themselves while inadvertently rotating the gaming-table support locking apparatus 107 (as disclosed below). Rather, the user can visually identify that the gaming-table support locking apparatus 107 is unlocked (or locked) and interact with the apparatus accordingly. This makes the gaming-table support locking apparatus 107 ideal for in-home use and particularly ideal for use with basketball game apparatus 100.

The backboard panel 102 may include additional features such as visual graphics, an electronic scoreboard, a manual scoreboard, a whiteboard or chalkboard, video camera technology, audio technology, speakers, etc. In other example embodiments, the backboard panel 102 may be configured for other types of games such as any one of billiards, foosball, bumper billiards, air hockey, table tennis, target toss, pinball soccer, finger football, bowling, chess, checkers, Chinese checkers, backgammon, basketball toss, football toss, bean bag toss, etc. Likewise, an alternate example embodiment, the backboard panel 102 may be configured to multi-game options (e.g., 6-in-1 or 20-in-1 gaming-table configurations). In alternate example embodiments, the first bar of the gaming-table support 106, the second bar of the gaming-table support 105, and the gaming-table support locking apparatus 107 may be configured to support these other types of games. In an example embodiment, the backboard panel 102 includes a plurality of basketball rims 103 (e.g., two or more). Likewise, the basketball rim 103 may include additional features such as a net, an electronic scoring sensor, a manual scoring sensor, etc.

The basketball game apparatus 100 may additionally include a center return net 108, disposed between the two side panels 101A-B. The center return net 108 may extend from the backboard panel 102 out toward a user. The center return net 108 may end at a cross bar 109. The center return net 108, in addition to the side boundary net 104A-B on each side panel 101A and 101B, may catch objects (e.g., basketballs) and send them to the user. For this reason, the center return net 108 typically has a downward slope (i.e., extending towards the floor as it extends away from the backboard panel 102). The cross bar 109 serves as a stop-point for any objects caught by the center return net 108. For example, once a basketball is caught by the center return net 108, it rolls downward along the slope of the center return net 108 until it is stopped by the cross bar 109. The cross bar may include additional features that may interact with the backboard panel 102. For example, if the backboard panel 102 includes an electronic scoreboard, the cross bar 109 may include a control panel, from which the user may select game-type, number of players, scoring limit, time limit, etc. Communications with the backboard panel 102 may be wired and/or wireless.

Folded Basketball Game Apparatus

Figure 2:
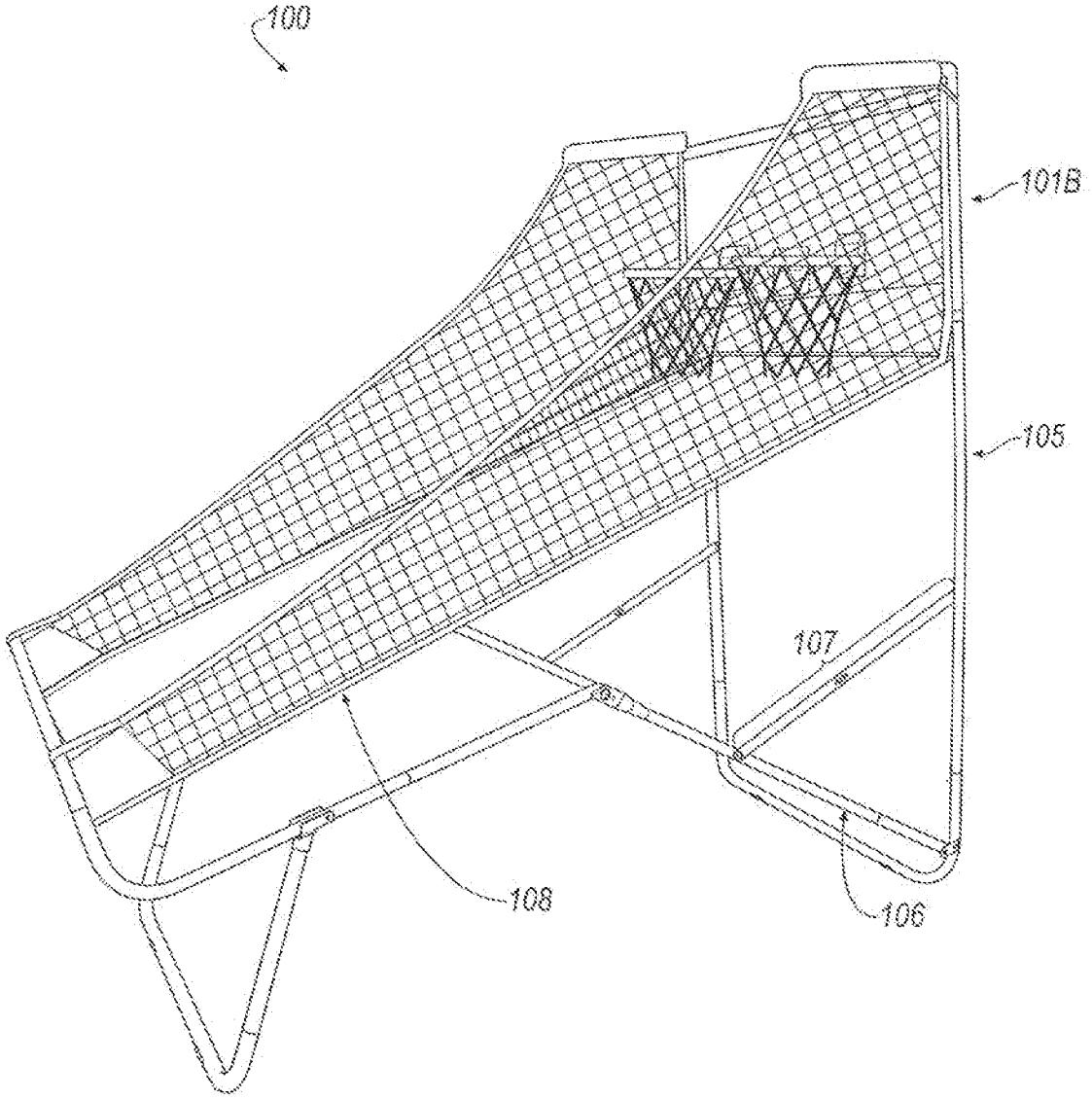
FIG. 2 shows a diagram of an example basketball game apparatus, according to an example embodiment of the present disclosure.

FIG. 2 shows a diagram of an example basketball game apparatus 100 of FIG. 1, according to an example embodiment of the present disclosure. In the example embodiment, the basketball game apparatus 100 is shown from a side view illustrating one of the two side panels 101B. This side panel 101B includes gaming-table support locking apparatus 107. The gaming-table support locking apparatus 107 includes additional features such as the first hinge bar, the second hinge bar, the window, the tab connector, and the tab notch (as noted above and detailed below).

As illustrated, the gaming-table support locking apparatus 107 is in a locked orientation, such that, the hinge bars associated with the gaming-table support locking apparatus 107 are aligned with one another. In the locked orientation, the hinge bars may not rotate with respect to one another (as described in greater detail below with reference to FIGS. 4-8C). This allows the structure of the basketball game apparatus 100 (e.g., side panels 101A-B) to remain fixed and sturdy. By comparison, for example, in an unlocked orientation the gaming-table support locking apparatus 107 is released. This means that the first bar of the gaming-table support 106 and the second bar of the gaming-table support 105 may collapse into a flat-form. Likewise, additional bars of the gaming-table support (e.g., the third bar of the gaming-table support 110 and the fourth bar of the gaming-table support 111) may collapse into a flat-form. Collapsing of the additional bars of the gaming-table support into a flat-form may include rotation about hinges (e.g., first hinge 120 and second hinge 121) as described herein. The center return net 108, likewise, may collapse into a flat-form.

Figure 3:
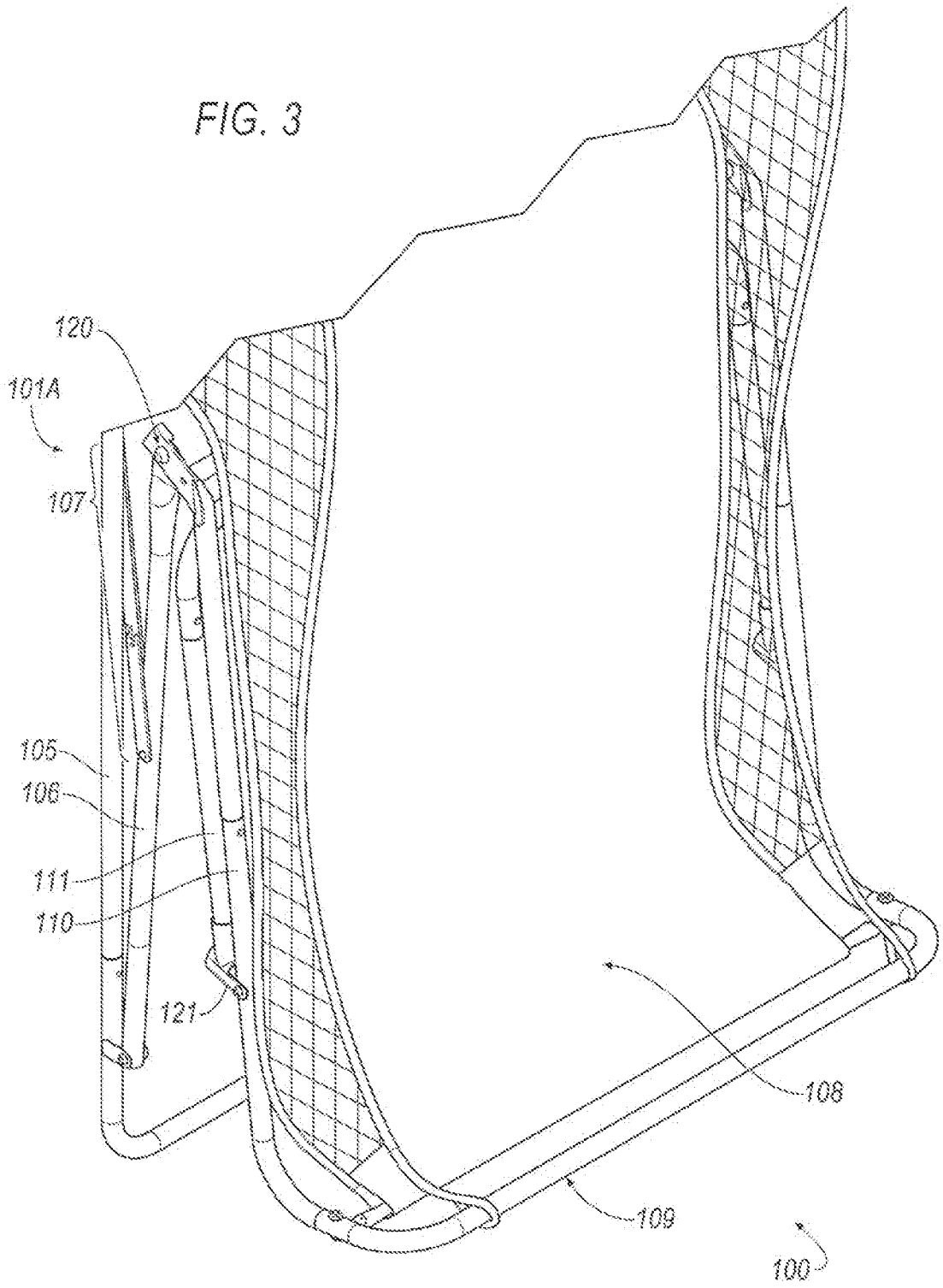
FIG. 3 shows a diagram of a fully folded example basketball game apparatus, according to an example embodiment of the present disclosure.

As compared to FIG. 2, FIG. 3 shows a diagram of a fully folded example basketball game apparatus 100, according to an example embodiment of the present disclosure. In an example embodiment, the basketball game apparatus 100 is folded into a flat-form. In this flat form, each of the two side panels 101A-B are collapsed. While only one side panel 101A is shown, a similar operation may be expected by the other side panel (e.g., side panel 101B). In an example embodiment, when side panel 101A collapses, side boundary net 104A is rotated inward such that it is parallel with the backboard panel 102. Likewise, the basketball rim 103 is folded flat and parallel with the backboard panel 102. Each of the first bar of the gaming-table support 106, the second bar of the gaming-table support 105, the gaming-table support locking apparatus 107, the third bar of the gaming-table support 110, and the fourth bar of the gaming-table support 111 are all collapsed into a flat-form. Additionally, the center return net 108 and the cross bar 109 are in a flat configuration. As fully folded, the basketball game apparatus 100 has a flat profile for easy storage (e.g., in a closet, under a bed or couch, etc.).

Gaming-Table Support Locking Apparatus

Figure 4:
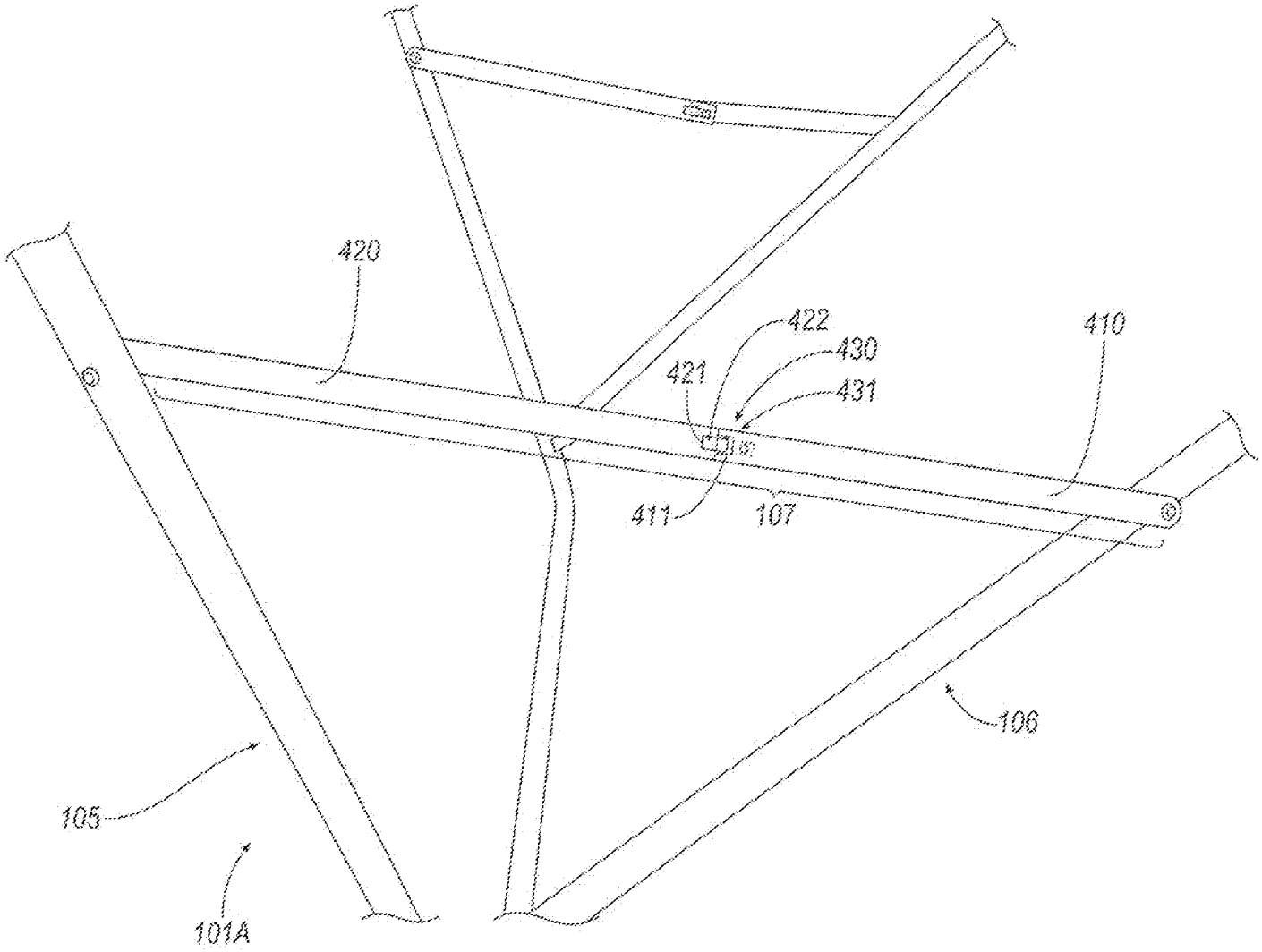
FIG. 4 shows a diagram of a gaming-table support locking apparatus, according to an example embodiment of the present disclosure.

FIG. 4 shows a diagram of the gaming-table support locking apparatus 107 of FIGS. 1-3, according to an example embodiment of the present disclosure. As illustrated in FIG. 4, one gaming-table support locking apparatus 107 for a side panel (e.g., side panel 101A) is shown in detail. In an example embodiment, an additional gaming-table support locking apparatus for another side panel (e.g., side panel 101B) may, likewise, exist (as depicted in FIGS. 1-2).

In an example embodiment, the gaming-table support locking apparatus 107 includes a first hinge bar 410 and a second hinge bar 420. In an example embodiment, the first hinge bar 410 and the second hinge bar 420 have rectangular shapes. In an example embodiment, the first hinge bar 410 and the second hinge bar 420 are comprised of a rigid material. For example, the rigid material may be any one of a rigid plastic, a metal, or any other material with a high modulus of elasticity (i.e., low flexibility). The first hinge bar 410 has a first end that is configured to connect to a first bar of a gaming-table support 106. The first hinge bar 410 also has a second end that has a tab notch 411. In an example embodiment, the tab notch 411 is a geometric void, disposed on an edge of the second end of the first hinge bar 410. In an example embodiment, the tab notch 411 has a rectangular profile. In an alternate example embodiment, the tab notch 411 has a different geometric profile, such as circular, half-circular, elliptical, triangular, hexagonal, octagonal, hooked, J-shaped, U-shaped, or any other geometric profile.

The second hinge bar 420 includes a first end that is configured to connect to a second bar of a gaming-table support 105. The second hinge bar 420 also has a second end that is rotatably connectable to the first hinge bar 410. In an example embodiment, the rotatable connection is made a location on or near the second end of the second hinge bar 420 and at a location on the first hinge bar 410 between the first end of the first hinge bar 410 and the second end of the first hinge bar 410. More particularly, the rotatable connection is made a location on or near the second end of the second hinge bar 420 and at a location on the first hinge bar 410 near the second end of the first hinge bar 410. In an example embodiment, this rotatable connection is a riveted lap joint. In alternate example embodiments, this rotatable connection may be a riveted butt joint, a butt hinge, a t-hinge, a strap hinge, a gate hinge, or any other equivalent type of hinge, joint, or linkage.

The second hinge bar 420 additionally includes a window 421. In an example embodiment, the window 421 is a geometric void, disposed on the second hinge bar 420. In an example embodiment, the window 421 has a rectangular profile. For example, the window 421 may be dimensioned to have a length of one inch, and a width of one-half inch. In alternate examples, the window 421 may have larger or smaller dimensions. In an alternate example embodiment, the window 421 has a different geometric profile, such as circular, half-circular, elliptical, triangular, hexagonal, octagonal, hooked, J-shaped, U-shaped, or any other geometric profile. The window 421 is located between the first end and the second end of the second hinge bar 420. More preferably, the window 421 is located near the second end of the second hinge bar 420. Additionally, the window 421 is disposed entirely within the second hinge bar 420, such that none of the geometric void defining the window 421 intersects an edge of the second hinge bar 420. In an alternate example embodiment, at least a portion of the geometric void defining the window 421 intersects at least one edge of the second hinge bar 420.

The gaming-table support locking apparatus 107 additionally includes a tab connector 422, which is described in greater detail with reference to FIGS. 5A-C below. The tab connector 422 is at least partially received by the window 421. In an example embodiment, the width of the window 421 and the width of the tab connector 422 are equivalent. In an example embodiment, the tab connector 422 is comprised of a flexible material. For example, the flexible material may be any one of a flexible plastic, a rubber, or any other material with a low modulus of elasticity (i.e., high flexibility). In an example embodiment, the tab connector 422 has a rectangular shape. For example, the tab connector 422 may be dimensioned to have a length of two inches, and a width of one-half inch. Likewise, as previously noted, the window 421 may be dimensioned to have a length of one inch, and a width of one-half inch. Therefore, in the example above, one inch of the length of the tab connector 422 is at least partially received by the window 421, whereas one inch of the length of the tab connector 422 is not received by the window 421. In alternate examples, the tab connector 422 may have larger or smaller dimensions. In an example embodiment, the tab connector 422 is a different color than the first hinge bar 410 and the second hinge bar 420, such that the tab connector 422 may be readily identifiable by the user. For example, the first hinge bar 410 and the second hinge bar 422 may be colored gray, whereas the tab connector 422 may be colored orange. In a different example embodiment, all components of the gaming-table support locking apparatus 107 are the same color.

In an example embodiment, the gaming-table support locking apparatus 107 additionally includes an extrusion 430 and an extrusion notch 431. The extrusion 430 and extrusion notch 431 may restrict rotation between the first hinge bar 410 and the second hinge bar 420 in a given direction. Constraining the first hinge bar 410 and the second hinge bar 420 to only rotate in a given direction ensures proper folding of the gaming-table support locking apparatus 107 and the basketball game apparatus 100. For example, the extrusion 430 and extrusion notch 431 ensure that individual components of the basketball game apparatus 100 (e.g., the first bar of the gaming-table support 106 and the second bar of the gaming-table support 105) do not fold in the wrong direction.

For example, the first hinge bar 410 has an extrusion 430, disposed on an edge of the first hinge bar 410 (e.g., a top edge of the first hinge bar 410). In an example embodiment, the extrusion 430 is a portion of the first hinge bar 410 extending in the direction perpendicular to the first hinge bar 410 and towards the tab connector 422 (e.g., a portion of the first hinge bar 410 with a thickness that is greater than that of the first hinge bar 410). Because the extrusion 430 has an extrusion thickness that is greater than a thickness of the first hinge bar 410, the extrusion 430 extends beyond the first hinge bar 410. In an example embodiment, the extrusion 430 has a rectangular profile. In an alternate example embodiment, the extrusion 430 has a different geometric profile, such as circular, half-circular, elliptical, triangular, hexagonal, octagonal, hooked, J-shaped, U-shaped, or any other geometric profile.

Likewise, for example, the second hinge bar 420 has an extrusion notch 431. The extrusion notch 431 is a geometric void, disposed on an edge of the second hinge bar 420 (e.g., a top edge of the second hinge bar 420). In an example embodiment, the extrusion notch 431 has a rectangular profile, larger than that of the extrusion 430. In an alternate example embodiment, the extrusion notch 431 has a different geometric profile, such as circular, half-circular, elliptical, triangular, hexagonal, octagonal, hooked, J-shaped, U-shaped, or any other geometric profile. As disclosed above, the extrusion 430 and the extrusion notch 431 are disposed on the same edge (i.e., the top edge) of their respective hinge bars. In a different example embodiment, the extrusion 430 and the extrusion notch 431 are disposed on a different edge (e.g., the bottom edge) of their respective hinge bars.

The extrusion notch 431 is aligned with the extrusion 430, such that the extrusion 430 engages with the extrusion notch 431 as the extrusion 430 extends in the direction perpendicular to the first hinge bar 410 and towards the tab connector 422. For example, the extrusion 430 extends in the direction perpendicular to the first hinge bar 410 and towards the tab connector 422. The extrusion 430 passes through at least a portion of the extrusion notch 431. In this way, the extrusion 430, which is disposed on the first hinge bar 410, intersects at least a portion the extrusion notch 431 on the second hinge bar 420. This intersection, between a component of the first hinge bar 410 (e.g., the extrusion 430) with a component of the second hinge bar 420 (e.g., the extrusion notch 431) may restrict rotation between the first hinge bar 410 and the second hinge bar 420 in a given direction. Restriction of rotation is described in additional detail below with reference to FIGS. 8A-D. In a different example embodiment, components may be reversed. For example, the extrusion 430 may be disposed on the second hinge bar 420 and the extrusion notch 431 may be disposed on the first hinge bar 410. In another different example embodiment, there may be a plurality of extrusions disposed on a single bar. For example, the first hinge bar 410 may have a plurality of extrusions. Likewise, for example, the second hinge bar 420 may have a plurality of extrusion notches.

Tab Connector

Figure 5A:
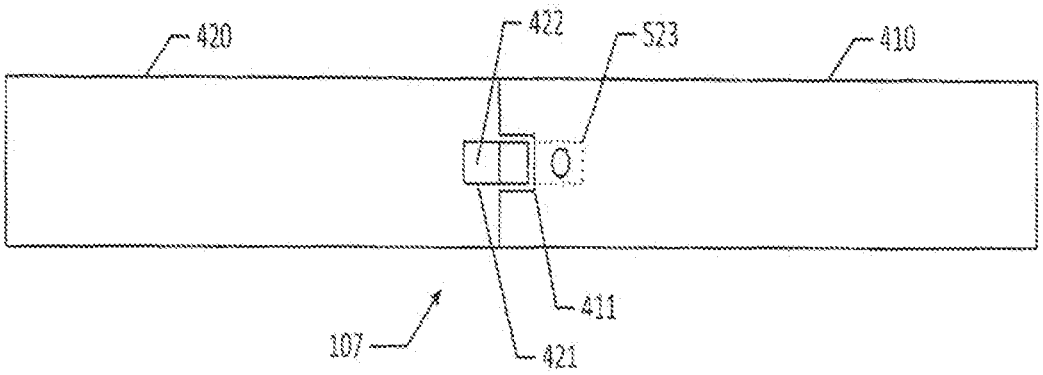
FIG. 5A-5C shows a multi-view diagram of a gaming-table support locking apparatus, according to an example embodiment of the present disclosure.
Figure 5B:
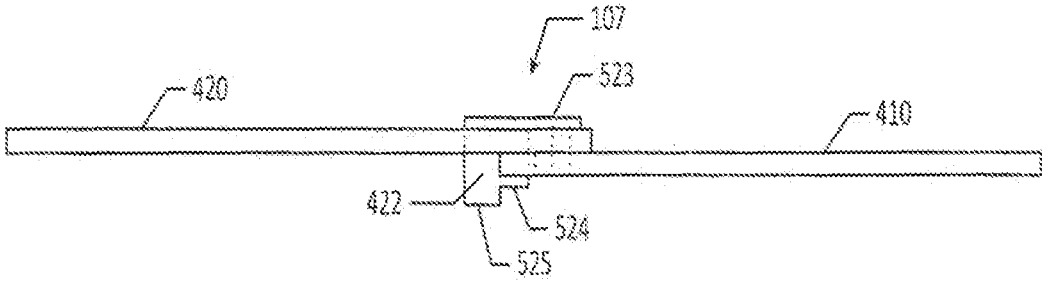
Figure 5C:
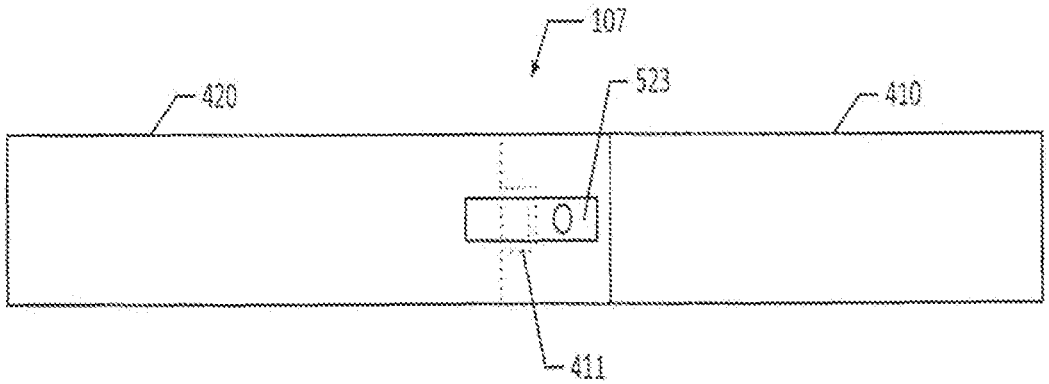

FIG. 5A-5C shows a multi-view diagram of the gaming-table support locking apparatus 107 in the locked state likewise depicted in FIG. 4, according to an example embodiment of the present disclosure. Each of FIG. 5A, FIG. 5B, and FIG. 5C is a different orthogonal view of the same gaming-table support locking apparatus 107. As noted previously, the basketball game apparatus 100 may include a plurality of gaming-table support locking apparatus (e.g., a gaming-table support locking apparatus 107 on each of the side panels 101A-B). Therefore, while the description that follows refers to gaming-table support locking apparatus 107, similar components and functionality may be expected by other gaming-table support locking apparatus.

As previously disclosed, the gaming-table support locking apparatus 107 includes a tab connector 422. More particularly, the tab connector 422 includes a base 523, a locking section 524 and a release section 525. In an example embodiment, the base 523 is a molded plastic piece that is configured to connect to both the second hinge bar 420 and to other components of the tab connector 422 (e.g., the locking section 524 and release section 525). In a different example embodiment, the base 523 is made up of a different flexible material such as flexible plastic, rubber, etc. The base 523 is configured to connect to the second hinge bar 420 at the window 421. In a different example embodiment, the base 523 is configured to connect to the second hinge bar 420 at a location near the window 421. The base 523 connects to the second hinge bar 420 on the side opposite the first hinge bar 410 (e.g., the second hinge bar 420 is between the base 523 and the first hinge bar 410). The base 523 has a rectangular profile, and is relatively thin (e.g., a thickness comparable to the thickness of the second hinge bar 420). In other example embodiments, the base 523 may be thicker and/or have a different geometric profile, such as circular, half-circular, elliptical, triangular, hexagonal, octagonal, hooked, J-shaped, U-shaped, or any other geometric profile. In an example embodiment, the width of the base 523 is slightly less than that of the window 421. This ensures that the base 523 and additional components of the tab connector 422 (e.g., the locking section 524 and release section 525) may at least partially pass through the window 421 in certain configurations.

The tab connector 422 further includes the locking section 524. In an example embodiment, the locking section 524 is a molded plastic piece that is configured to connect to the base 523. In a different example embodiment, the locking section 524 is made up of a different flexible material such as flexible plastic, rubber, etc. The locking section 524 connects to the base 523 on the side of the base 523 closer to the first hinge bar 410 (e.g., in a direction from the base 523 towards the window 421). The locking section 524 has a rectangular profile, and is relatively thick, compared to the base 523. For example, the locking section 524 has a first height extending from the base 523 through the window 421, such that the entire rectangular profile of the locking section 524 extends through the window 421. In other example embodiments, locking section 524 may have a different geometric profile, such as circular, half-circular, elliptical, triangular, hexagonal, octagonal, hooked, J-shaped, U-shaped, or any other geometric profile. In an example embodiment, the profile of the locking section 524 is slightly less than the width of the window 421. This ensures that the entire profile of the locking section 524 may extend through the window 421.

Additionally, the locking section 524 extends from the base 523, through the window 421, and through the tab notch 411, such that it engages the tab notch 411 to form a secure connection. More particularly, by engagement, the locking section 524 has the first height, extending from the base 523, in the direction perpendicular to the second hinge bar 420 and towards the window 421. The locking section 524 passes through the window 421. Likewise, the locking section 524 passes through at least a portion of the tab notch 411. In this way, the locking section 524, which is disposed on the second hinge bar 420, intersects at least a portion of the tab notch 411 on the first hinge bar 410. This intersection between a component of the second hinge bar 420 (e.g., the locking section 524) with a component of the first hinge bar 410 (e.g., the tab notch 411) forms a secure connection that restricts rotation between the first hinge bar 410 and the second hinge bar 420. For example, the first hinge bar 410 cannot rotate with respect to the second hinge bar 420 (and vice-a-versa) because if the first hinge bar 410 rotates, the tab notch 411 likewise would rotate, but the locking section 524 (which is not attached to the first hinge bar 410) would not rotate. Thus, the presence of the locking section 524 intersecting the tab notch 411 restricts rotation.

The tab connector 422 further includes the release section 525. In an example embodiment, the release section 525 is a molded plastic piece that is configured to connect to the base 523 and the locking section 524. In a related example embodiment, the base 523, the locking section 524, and the release section 525 are one single component (e.g., an injection molded plastic component). In a different example embodiment, the release section 525 is made up of a different flexible material such as flexible plastic, rubber, etc. The release section 525 connects to the base 523 on the side of the base 523 closer to the first hinge bar 410 (e.g., in a direction from the base 523 towards the window 421). Likewise, the release section 525 is connected to the locking section 524. The release section 525 has a rectangular profile, and is relatively thick, compared to the base 523. For example, the release section 525 has a second height, greater than the first height of the locking section 524. The second height of the release section extends from the base 523 through the window 421, such that the entire rectangular profile of the locking section 524 extends through the window 421. In other example embodiments, release section 525 may have a different geometric profile, such as circular, half-circular, elliptical, triangular, hexagonal, octagonal, hooked, J-shaped, U-shaped, or any other geometric profile. In an example embodiment, the profile of the release section 525 is slightly less than the width of the window 421. This ensures that the entire profile of the release section 525 may extend through the window 421.

In an example embodiment, there are some notable differences between the release section 525 and the locking section 524. For example, the release section 525 has a second height greater than the first height of the locking section 524. Though the release section 525 extends from the base 523, through the window 421, the release section 525 does not extend through the tab notch 411. Rather, the release section 525 does not intersect the geometric void defined by the tab notch 411 in any way. Additionally, because the release section 525 has a second height greater than the first height of the locking section 524, the release section 525 is configured to receive force from a user (as explained below with reference to FIGS. 6A-B). By comparison, the first height of the locking section 524, though intersecting the tab notch 411, may barely extend beyond the tab notch 411 in the direction away from the base 523 (e.g., the locking section 524 may be flush or nearly flush with the first hinge bar 410 at the tab notch 411). Thus, in an ideal embodiment, the locking section 524 is configured to intersect a portion of the tab notch 411, whereas the release section 525 is configured to not intersect a portion of the tab notch 411 but extend beyond the locking section 524 in the direction away from the base 523 to receive force from a user.

Figure 6A:
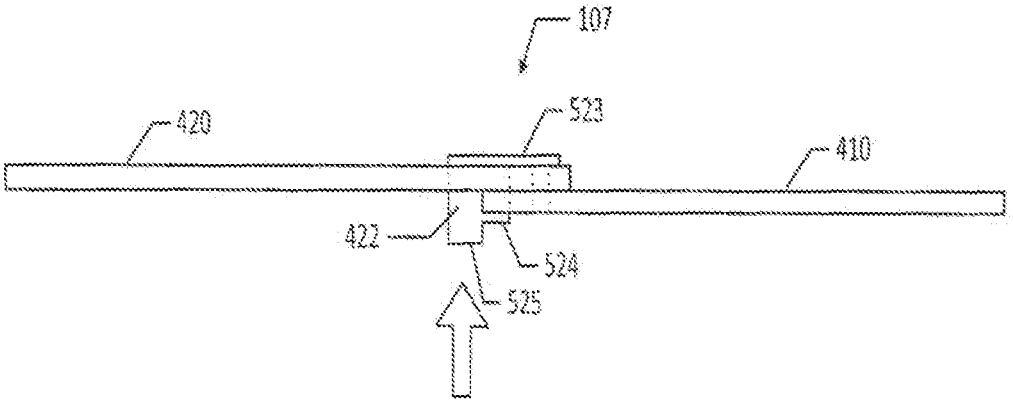
FIG. 6A-6B shows release of the gaming-table support locking apparatus, according to an example embodiment of the present disclosure.
Figure 6B:
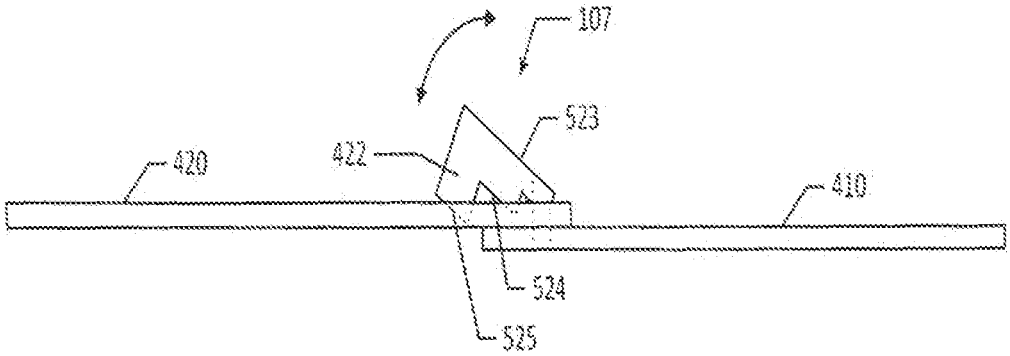

FIG. 6A-6B shows the gaming-table support locking apparatus 107 in a released state, according to an example embodiment of the present disclosure. For example, by depressing the tab connector 422, as illustrated by FIG. 6A, (e.g., pushing on the tab connector 422 with a finger), and more particularly depressing the release section 525 of the tab connector 422, the tab connector 422 is physically actuated through the window 421, as illustrated by FIG. 6B.

More specifically, for example, a user may depress the tab connector 422 by pushing on the release section 525 in a direction perpendicular to the second hinge bar 420 and towards the base 523, to release the tab connector 422. More particularly, by release, the user depresses the tab connector 422 (e.g., pushes on the tab connector 422 with a finger), and more particularly depresses the release section 525 of the tab connector 422. In an example embodiment, the release section 525 of the tab connector 422 includes a tactile feature (e.g., bumps, ridges, concave/convex indentation, etc.) configured to receive force (e.g., tactile force) from the user. In alternate example embodiments, the force may be via other mechanical actuation, electromechanical actuation, robotics, etc. In an alternate example embodiment, the tab connector 422 may be depressed through other means such as with an external tool. In a different alternate example embodiment, the tab connector 422, and more particularly the base 423 has an external grip, such that the tab connector 422 may be pulled, via the external grip, from the side of the base 423 as opposed to being depressed from the side of the release section 525.

In response to depressing the release section 525, the tab connector 422 is at least partially actuated through the window 421. For example, in an example embodiment, responsive to receiving the physical actuation, the tab connector 422 bends about a fulcrum, the fulcrum being location where the base 523 of the tab connector 422 is connected to the second hinge bar 420 (e.g., the tab connector 422 may act as a Class 2 lever). The release section 525 is configured to be depressed toward the base 523. As previously noted, the release section 525 is connected to both the base 523 and the locking section 524. Alternatively, the base 523, the locking section 524, and the release section 525 are one single component (e.g., an injection molded plastic component). Because the release section 525 and the locking section 524 are both connected to the base 523, as the release section 525 is depressed toward the base 523 the locking section 524, likewise, is depressed toward the base 523. This causes the locking section 524 to disengage from the tab notch 411.

More particularly, by disengagement, the locking section 524 has the first height, extending from the base 523, in the direction perpendicular to the second hinge bar 420 and towards the window 421. The locking section 524 passes through the window 421. However, the locking section 524 no longer passes through at least a portion of the tab notch 411. In other words, the locking section 524, which is disposed on the second hinge bar 420, no longer intersects at least a portion of the tab notch 411, on the first hinge bar 410. The secure connection, which restricted rotation between the first hinge bar 410 and the second hinge bar 420, has been eliminated, such that the locking section 524 no longer restricts rotation of the second hinge bar 420 about the first hinge bar 410. At the same time, though depressed, the release section 525 may still extend at least partially through the window 421. This ensures that the user (e.g., the user's finger) is not contacting the first hinge bar 410 or the second hinge bar 420. For example, the user's finger remains on the release section 525, which is at least partially raised and is thus clear of the tab notch 411 and the window 421. This ensures that the user's finger does not come into contact with pinch points (e.g., the first hinge bar 410, the second hinge bar 420, the tab notch 411, or the window 421) as the first hinge bar 410 and the second hinge 420 bar rotate (as described below and illustrated by FIG. 7A-B).

In an example embodiment, the window 421 and a portion of the tab connector 422, including the locking section 524 and the release section 525 have equivalent shapes. For example, the window 421 may have a rectangular shape. Likewise, the locking section 524 and the release section 525 have a rectangular shape. In this sense, the locking section 524 and the release section 525 extend from the base 523 through the window 421, such that a minimal gap exists between the perimeter of the locking section 524 and the release section 525, and the window 421. While the example embodiment above explains a rectangular-shaped configuration, the window 421 and a portion of the tab connector 422, including the locking section 524 and the release section 525 may have other geometric shapes (e.g., circular, half-circular, elliptical, triangular, hexagonal, octagonal, or any other geometric shape). For example, the locking section 524 and the release section 525 may each be a half-circle, such that combined they form a complete circular shape. Likewise, for example, the window 421 may have a circular shape, such that a minimal gap exists between the perimeter of the locking section 524 and the release section 525, and the window 421.

In a different example embodiment, components may be reversed. For example, the tab connector 422, including the base 523, the locking section 524, and the release section 525, and the window 421 may be disposed on the first hinge bar 410. Likewise, the tab notch 411 may be disposed on the second hinge bar 420. In another different example embodiment, there may be a plurality of windows and a plurality of tab connectors disposed on a single bar. For example, the second hinge bar 420 may have a plurality of windows and a plurality of tab connectors. Likewise, for example, the first hinge bar 410 may have a plurality of tab notches.

Prior to the release section 525 being depressed towards the base 523 (and the locking section 524 disengaging from the tab notch 411), the gaming-table support locking apparatus 107 is in a locked orientation. For example, and as previously noted the locking section 524 of the tab connector 422 extends from the base 523 through the window 421. The locking section 524 engages the tab notch 411 and forms a secure connection. Thus, the second hinge bar 420 is restricted from rotating about the first hinge bar 410 in either direction. In this sense, the gaming-table support locking apparatus 107 is locked.

Rotation of Gaming-Table Support Locking Apparatus

Figure 7A:
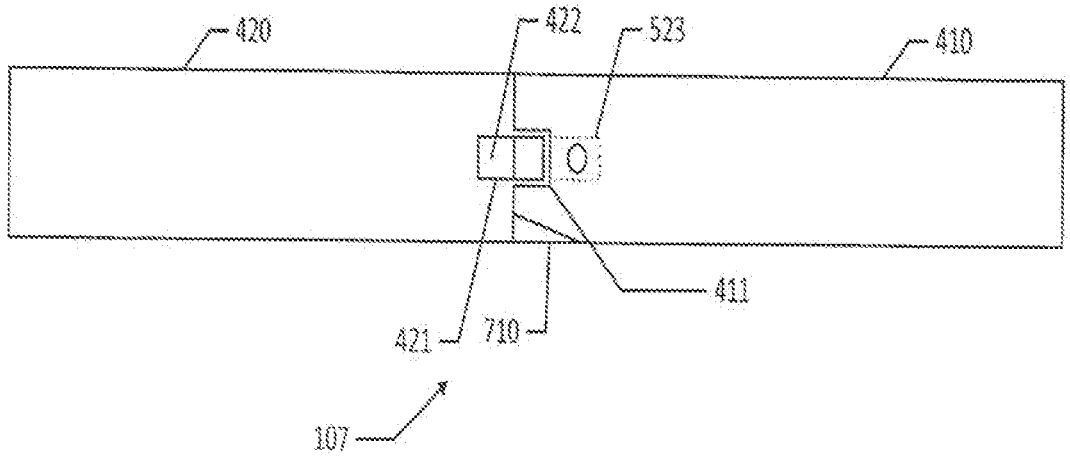
FIG. 7A-7B shows rotation of the gaming-table support locking apparatus, in response to release of the gaming-table support locking apparatus, according to an example embodiment of the present disclosure.
Figure 7B:
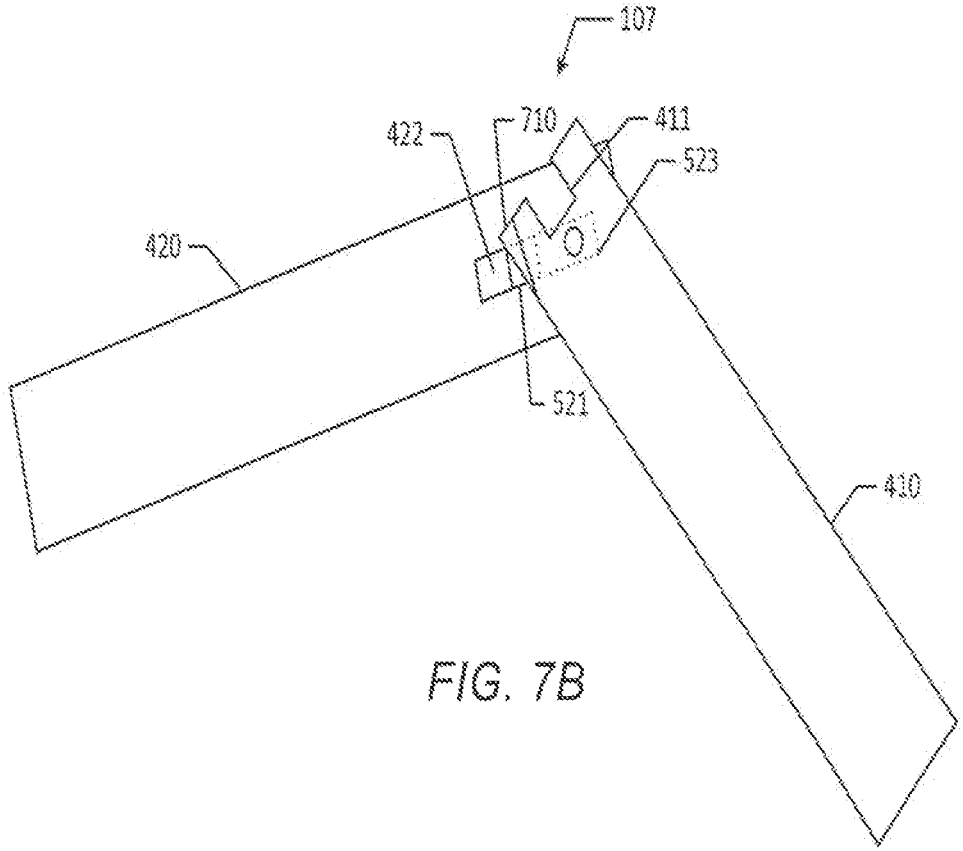

FIG. 7A-7B shows rotation of the gaming-table support locking apparatus 107, in response to release of the gaming-table support locking apparatus, according to an example embodiment of the present disclosure. For example, the tab connector 422 is released (as described above with reference to FIGS. 6A-6B). Responsive to releasing the tab connector 422, the tab connector 422 no longer restricts rotation of the second hinge bar 420, such that the second hinge bar 420 is able to rotate in a particular direction about a first hinge bar 410.

More particularly, and as previously noted, the second hinge bar 420 and the first hinge bar 410 are rotatably connected. In an example embodiment, this rotatable connection is a riveted lap joint. The second hinge 420 bar may rotate about the first hinge bar 410 such that the second hinge bar 420 may be aligned in relation to the first hinge bar 410, as illustrated by FIG.

Likewise, the second hinge bar 420 may rotate about the first hinge bar 410 such that the second hinge bar 420 may be angled in relation to the first hinge bar 410, as illustrated by FIG.

In an example embodiment, the rotatable connection is configured such that the second hinge bar 420 may rotate to any degree, in relation to the first hinge bar 410.

In an example embodiment, the first hinge bar 410 includes a flare 710. For example, the flare 710 is a corner of the first hinge bar 410 that extends away from the second hinge bar 420. The flare 710 may encourage proper alignment between the first hinge bar 410 and the second hinge bar 420 as the gaming-table support locking apparatus 107 transitions from an unlocked configuration to a locked configuration. Additionally, the flare 710 may facilitate the transition from unlocked configuration to a locked configuration. For example, the gradual slope of the flare 710 will ensure that the tab connector 422 (more particularly the locking section 524) is properly engaged (i.e., not extending through the window 421) as the first hinge bar 410 and the second hinge bar 420 rotate to a locked configuration.

Figure 8A:
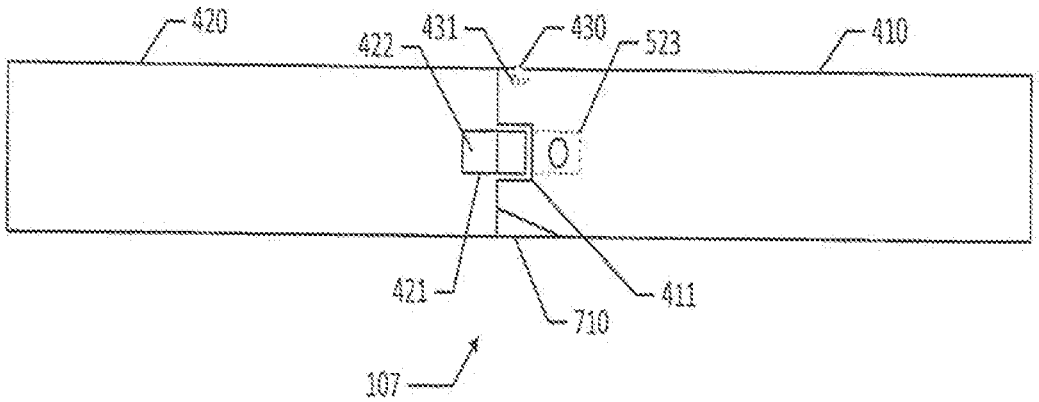
FIG. 8A-8D shows rotation and restricted rotation of the gaming-table support locking apparatus, in response to release of the gaming-table support locking apparatus, according to an example embodiment of the present disclosure.

In a related example embodiment, rotation may be restricted in a particular direction, or to a particular degree. For example, FIG. 8A-8D shows rotation and restricted rotation of the gaming-table support locking apparatus 107, in response to release of the gaming-table support locking apparatus, according to an example embodiment of the present disclosure. More particularly, FIGS. 8A and 8D are different orthogonal views of the gaming-table support locking apparatus 107 including the extrusion 430 and the extrusion notch 431. As illustrated, particularly with reference to FIG. 8D, the extrusion 430 has an extrusion thickness that is greater than a thickness of the first hinge bar 410, extending in the direction perpendicular to the first hinge bar 410 and towards the tab connector 422. The extrusion notch 431 is disposed on an edge of the second hinge bar 420 and is aligned with the extrusion 430. The extrusion 430 engages with the extrusion notch 431 as the extrusion 430 extends in the direction perpendicular to the first hinge bar 410 and towards the tab connector 422. FIG. 8D also illustrates the flare 710, on the corner of the first hinge bar 410 and extending away from the second hinge bar 420.

Figure 8B:
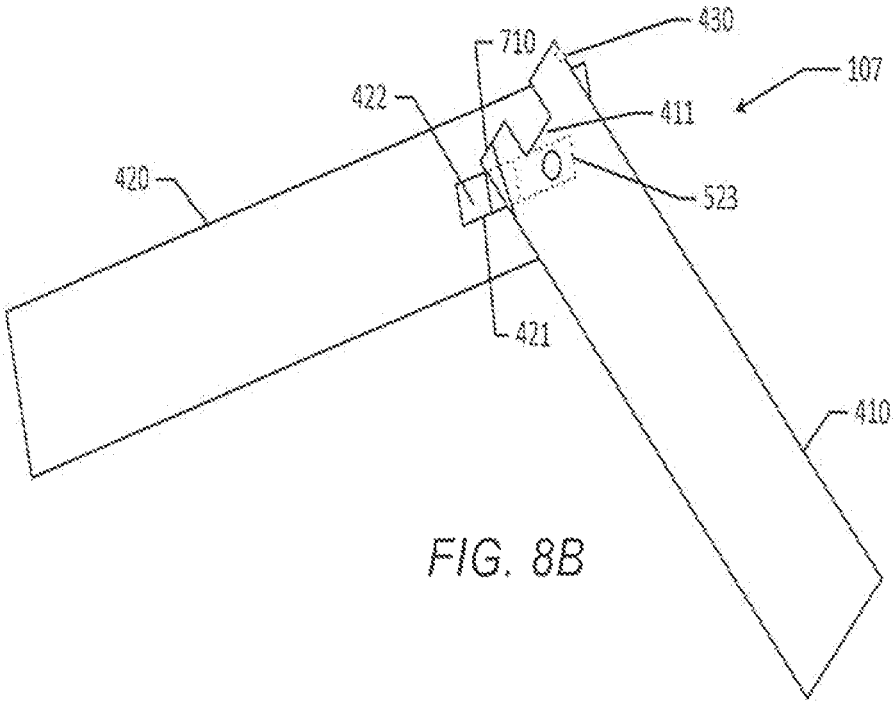
Figure 8C:
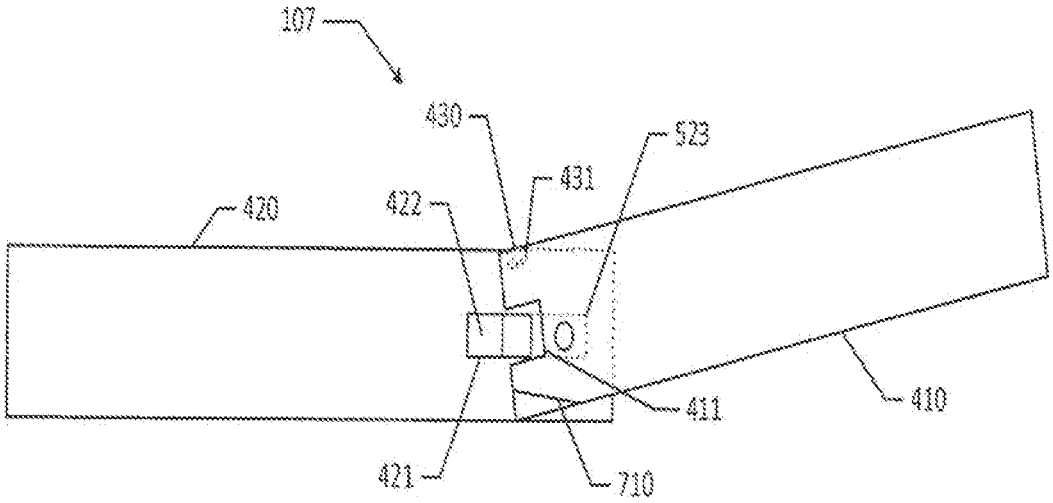
Figure 8D:
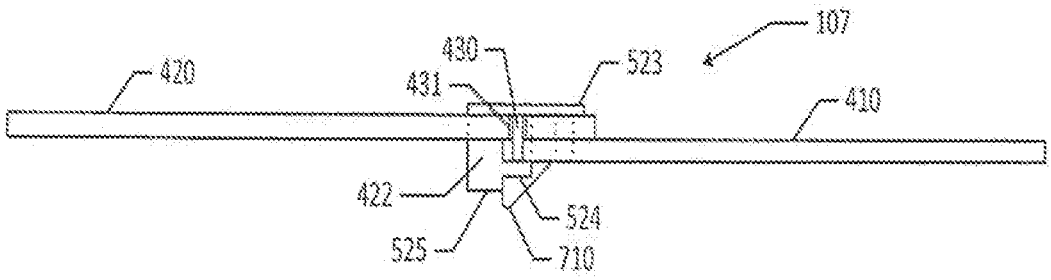

FIGS. 8B-8C illustrate an exemplary operation and rotation with the extrusion 430. For example, responsive to releasing the tab connector 422, the gaming-table support locking apparatus 107 is able to rotate in a first direction (as illustrated by FIG. 8B). More particularly, the second hinge bar 420 is able to rotate about the first hinge bar 410 in a first direction. However, as illustrated by FIG. 8C, when the second hinge bar 420 rotates about the first hinge bar 410 in a second direction, the extrusion 430 engages with the extrusion notch 431. Because the extrusion 430 (a component of the first hinge bar 410) cannot rotate through the second hinge bar 420, the extrusion 430 restricts rotation of the first hinge bar 410 relative to the second hinge bar 420

(and vice-a-versa). In this sense, the extrusion 430 on the first hinge bar 410 restricts rotation in the second direction. It is important to note that this restriction of rotation is occurring regardless of the fact that the tab connector 422 is released. In other words, even though the tab connector 422 is released, the second hinge bar 420 is unable to rotate about the first hinge bar 410 in the second direction, because the extrusion 430 has engaged with the extrusion notch 431. As disclosed above, the extrusion 430 and the extrusion notch 431 are disposed on the same edge (i.e., the top edge) of their respective hinge bars. In a different example embodiment, the extrusion 430 and the extrusion notch 431 are disposed on a different edge (e.g., the bottom edge) of their respective hinge bars.

Method of Releasing the Gaming-Table Support Locking Apparatus

In an example embodiment, with reference to FIG. 6A-B, a method of unlocking the gaming-table support locking apparatus includes disengaging the locking section 524 of the tab connector 422. More particularly, and as illustrated by FIG. 6A, disengaging the locking section 524 of the tab connector 524 includes inputting, by a user, a force on the release section 525 of the tab connector 422. In an example embodiment, the force may be via a human finger. In different example embodiments, the force may be via other mechanical actuation, electromechanical actuation, robotics, etc. As illustrated by FIG. 6B, the method further includes, responsive to receiving the force from the user, bending the tab connector 422 about a fulcrum. In an example embodiment, the fulcrum is the rotatable connection between a first hinge bar 410 and a second hinge bar 420. The base 523 base of the tab connector 422 is attached to this rotatable connection. The method further includes depressing the release section 525 of the tab connector 422 towards the base 523 of the tab connector 422, causing the locking section 524 of the tab connector 422 to disengage from the tab notch 411 on the first hinge bar 410. The method further includes visually ensuring that the locking section 524 of the tab connector 422 has been disengaged from the tab notch 411 on the first hinge bar 410. The method further includes rotating the second hinge bar 420, including the window 421, about the first hinge bar 410.

Use of Gaming-Table Support Locking Apparatus in Relation to Folded Basketball Game Apparatus In an example embodiment, the basketball game apparatus 100 may include additional structural limitations. For example, and with reference to FIG. 1, in addition to the components disclosed, the basketball game apparatus 100 includes the third bar of a gaming-table support 110 and the fourth bar of a gaming-table support 111 on each of the two side panels 101A-B. In an example embodiment, the second bar of the gaming-table support 105 is mechanically coupled to the first bar of the gaming-table support 106 by a gaming-table support locking apparatus 107. A first end of the first bar of the gaming-table support 106 is rotatably coupled to the second bar of the gaming-table support 105. A second end of the second bar of the gaming-table support 105 is connected to a first end of the third bar of the gaming-table support 110 by the first hinge 120. A second end of the third bar of the gaming-table support 110 is connected to the cross bar 109. The third bar of the gaming-table support 110 is also connected to a first end of the fourth bar of a gaming-table support 111 by the second hinge 121. A second end of the fourth bar of the gaming-table support 111 contacts the floor. In an example embodiment, at least some bars of the gaming-table support (e.g., the second end of the fourth bar of the gaming-table support 111) have wheels that contact the floor.

In an example embodiment, by releasing the gaming-table support locking apparatus 107 on side panel 101A, and likewise releasing the gaming-table support locking apparatus on side panel 101B, the gaming-table support locking apparatus 107 rotates (on each side panel). Likewise, the first bar of the gaming-table support 106 rotates up to the second bar of the gaming-table support 105. The third bar of the gaming-table support 110 and the fourth bar of the gaming-table support 111 rotate with respect to the first hinge 120 and the second hinge 121. In this way, the entire basketball game apparatus 100 may fold into a compact flattened configuration.

For example, in an example embodiment, the process of folding the basketball game apparatus 100 includes unlocking two side panels 101A-B, including releasing the gaming-table support locking apparatus 107 on side panel 101A, and likewise releasing the gaming-table support locking apparatus on side panel 101B. Additionally, the user may rotate the fourth bar of the gaming-table support 111 about the second hinge 121, so that the fourth bar of the gaming-table support 111 is underneath and parallel to the third bar of the gaming-table support 110. The user may push the cross bar 109 in a vertical direction towards a floor and in a horizontal direction towards the backboard panel 102, such that the third bar of the gaming-table support 110 and the fourth bar of the gaming-table support 111 rotate about the first hinge 120 to be parallel with the first bar of the gaming-table support 106. These components may then collapse parallel to the second bar of the gaming-table support 105, as long as the gaming-table support locking apparatus 107 is in an unlocked orientation. The user may then raise the hinged basketball rim 103, such that the hinged basketball rim 103 is parallel with the backboard panel 102. The user may then rotate the side boundary net 104A and 104B on each side panel 101A and 101B, such that each side boundary net 104A and 104B is parallel with the backboard panel 102. The user may additionally detach the cross bar 109 from a first end of the fourth bar of the gaming-table support 111 on each of the side panels 101A-B. Once in its compact flattened configuration, the basketball game apparatus 100 may be stored in any storage location (e.g., in a closet, under a bed, behind a door, etc.).

Alternate Gaming-Table Support Locking Apparatus

Figure 9:
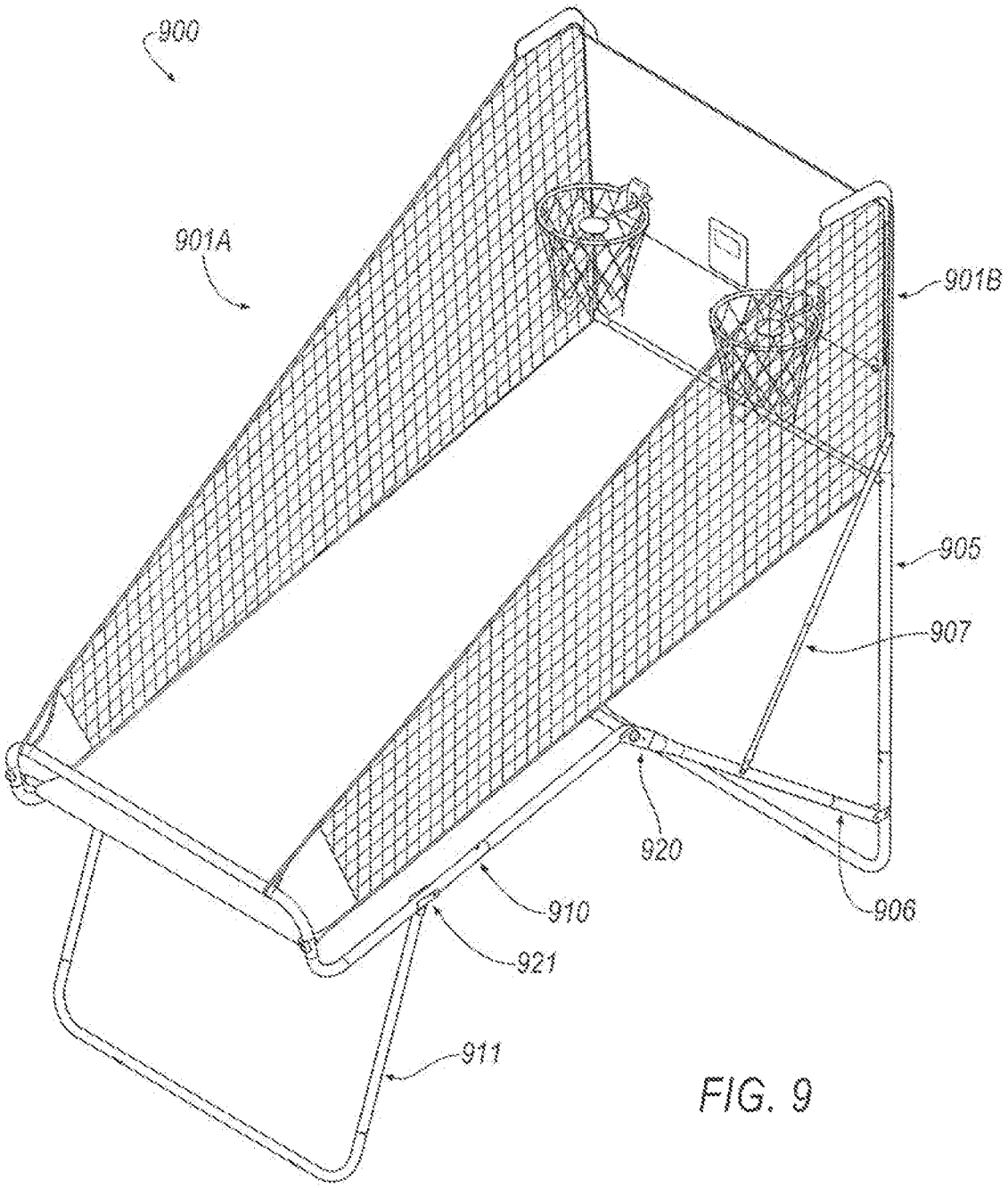
FIG. 9 shows a diagram of an alternate example basketball game apparatus, according to an example embodiment of the present disclosure.
Figure 10:
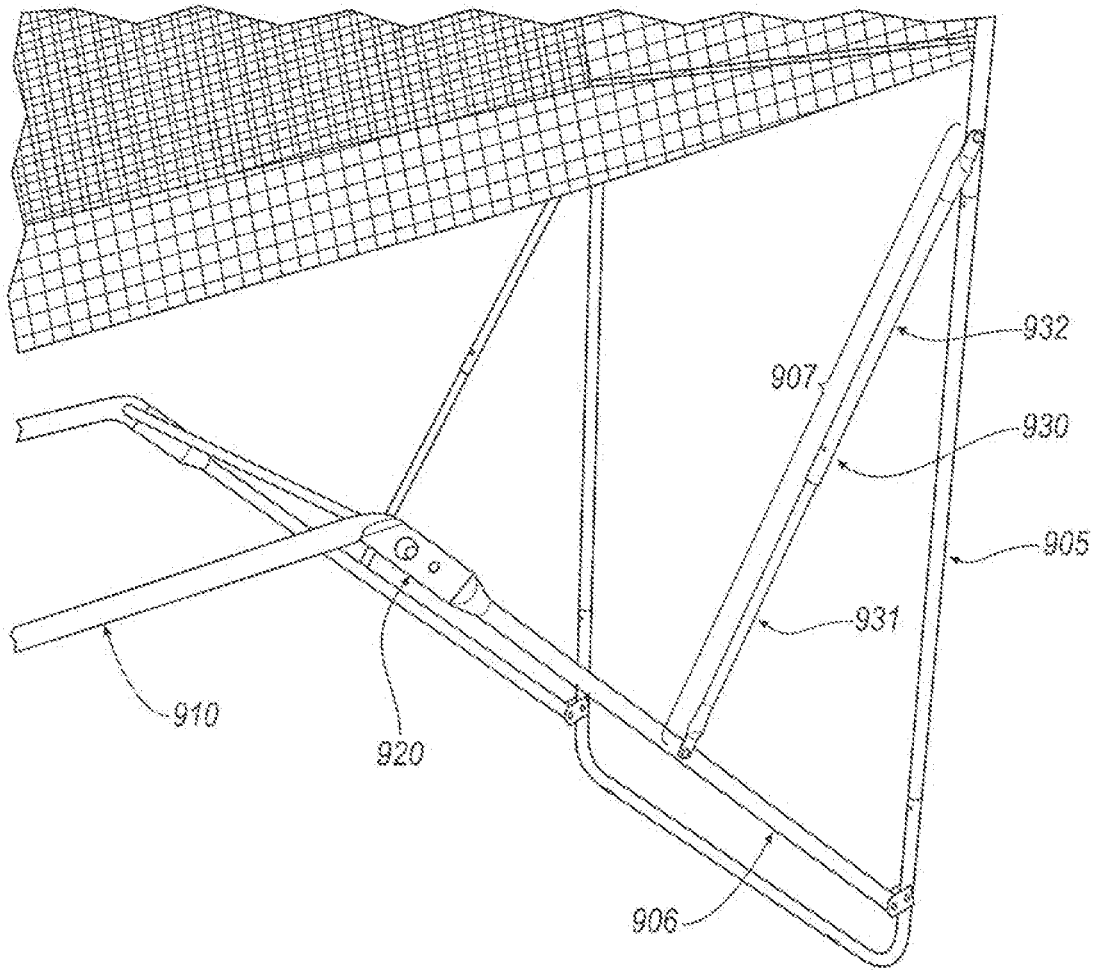
FIG. 10 shows a diagram of an alternate gaming-table support locking apparatus, according to an example embodiment of the present disclosure.
Figure 11:
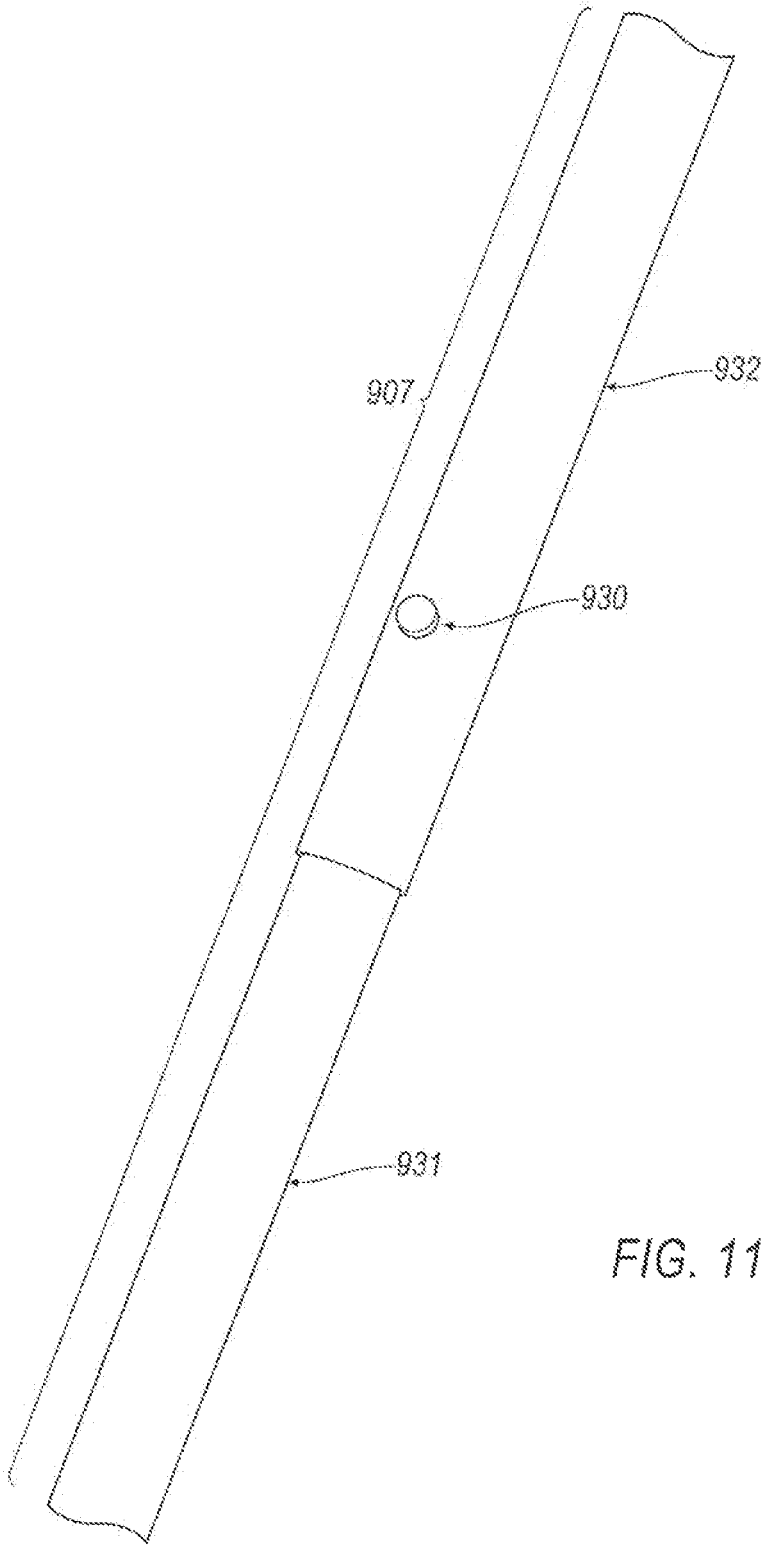
FIG. 11 shows a diagram of an alternate gaming-table support locking apparatus, according to an example embodiment of the present disclosure.

An alternate example basketball game apparatus 900 may include similar structural components while utilizing an alternate gaming-table support locking apparatus 907. In a non-limiting alternate example embodiment, as illustrated by FIGS. 9-11, the basketball game apparatus 900 includes two side panels 901A-B. As illustrated by FIG. 9, in an example embodiment the two side panels 901A-B are mirror images of one another, such that each of the two side panels 901A-B includes the same structure and components. Further, each of the two side panels 901A-B additionally includes a first bar of a gaming-table support 906 and a second bar of a gaming-table support 905. In other example embodiments, each side panel 901A and 901B may include additional bars of the gaming-table support (e.g., a third bar of the gaming-table support 910 and a fourth bar of the gaming-table support 911). Each of the first bar of the gaming-table support 906 and the second bar of the gaming-table support 905 are configured to support a portion of the basketball game apparatus 900 above the floor. Each of the two side panels 901A-B may additionally include at least one gaming-table support locking apparatus (e.g., gaming-table support locking apparatus 907). In other embodiments, each of the two side panels 901A-B may include multiple gaming-table support locking apparatus. In other embodiments, each of the two side panels 901A-B may include additional features such as hinges (e.g., first hinge 920 and second hinge 921).

With reference to FIGS. 10-11, in an example embodiment, the gaming-table support locking apparatus 907 is disposed between the first bar of the gaming-table support 906 and the second bar of the gaming-table support 905. The gaming-table support locking apparatus 907 is fixed to each of the first bar of the gaming-table support 906 and the second bar of the gaming-table support 905. In this alternate example embodiment, the gaming-table support locking apparatus 907 is composed of two bars: a first telescoping bar 931 and a second telescoping bar 932, which are telescopically engaged with one another. A first end of the first telescoping bar 931 is rotatably fixed to the first bar of the gaming-table support 906. A first end of the second telescoping bar 932 is rotatably fixed to the second bar of the gaming-table support 905. A second end of the first telescoping bar 931 is telescopically engaged with the second end of the second telescoping bar 932. For example, the first telescoping bar 931 is at least partially disposed inside the second telescoping bar 932, such that the first telescoping bar 931 may slide relative to the second telescoping bar 932. The gaming-table support locking apparatus 907 additionally includes a telescope button 930. For example, the telescope button 930 is an internal push button locking mechanism. In an example embodiment, the telescope button 930 extends through a window of the gaming-table support locking apparatus 907. For example, the telescope button 930 extends through a window defined by each of the first telescoping bar 931 and the second telescoping bar 932.

Through implementation of the telescope button 930, the gaming-table support locking apparatus 907 may be either not engaged (i.e., preventing telescoping) or engaged (i.e., allowing telescoping). For example, when the telescope button 930 is not engaged, it extends through the window of the gaming-table support locking apparatus 907. The first telescoping bar 931 and the second telescoping bar 932 are unable to slide (e.g. telescope) relative to one another because the telescope button 930 extends through the window defined by each of the first telescoping bar 931 and the second telescoping bar 932. However, when the telescope button 930 is engaged by a user, such that it no longer extends through the window of the gaming-table support locking apparatus 907, the first telescoping bar 931 and the second telescoping bar 932 slide (e.g., telescope) relative to one another. For example, the length of the gaming-table support locking apparatus 907 may be telescopically adjustable when the telescope button 930 is engaged because the first telescoping bar 931 and the second telescoping bar 932 are able to slide relative to one another.

In an example embodiment, by telescoping, the gaming-table support locking apparatus 907 may perform a similar function as rotation of the first hinge bar 410 and the second hinge bar 420 by the gaming-table support locking apparatus 107. For example, to close (e.g., collapse) the basketball game apparatus 900, the first bar of the gaming-table support 906 is rotated to be flat and parallel with the second bar of the gaming-table support 905. Because the gaming-table support locking apparatus 907 is disposed between the first bar of the gaming-table support 906 and the second bar of the gaming-table support 905, the length of the gaming-table support locking apparatus 907 must shorten or reduce as the first bar of the gaming-table support 906 is rotated to be flat and parallel with the second bar of the gaming-table support 905. To create this adjustably shortened length, a telescopically adjustable gaming-table support locking apparatus 907 is used. For example, as the first bar of the gaming-table support 906 is rotated to be flat and parallel with the second bar of the gaming-table support 905, the first telescoping bar 931 slides and is disposed within the second telescoping bar 932, such that the total length of the gaming-table support locking apparatus 907 may be shortened or reduced. In this way, a telescopically adjustable gaming-table support locking apparatus 907 may facilitate the collapsing and storage of the basketball game apparatus 900.

Likewise, when the basketball game apparatus 900 is opened (e.g., opened from a collapsed configuration to a playable configuration), the first bar of the gaming-table support 906 is rotated away from the second bar of the gaming-table support 905. Because the gaming-table support locking apparatus 907 is disposed between the first bar of the gaming-table support 906 and the second bar of the gaming-table support 905, the length of the gaming-table support locking apparatus 907 must extend or increase as the first bar of the gaming-table support 906 is rotated away from the second bar of the gaming-table support 905. To have an extendable length, the first telescoping bar 931 slides away from the second telescoping bar 932, such that the total length of the gaming-table support locking apparatus 907 may be extended or increased. In this way, a telescopically adjustable gaming-table support locking apparatus 907 may facilitate the opening of the basketball game apparatus 900.

As disclosed herein, the gaming-table support locking apparatus 907 is self-contained. It does not require a number of different components that could be lost or misplaced (e.g., a snap clamp with a flexible fitting and two rods or bars). Likewise, for example, the gaming-table support locking apparatus 907 is configured to require an ideal force (e.g., the pushing force from one finger of the user) for engagement of the telescope button 930. The mechanical design of the gaming-table support locking apparatus 907 provides for secure connections in both locked and unlocked states. Additionally, for example, the gaming-table support locking apparatus 907 provides for visual identification of the mechanism's condition (i.e., locked or unlocked). For example, the user may visually identify the telescope button 930, and thus assume that the mechanism is in a locked condition; alternatively, if the telescope button 930 on the gaming-table support locking apparatus 907 is not visible, the user may assume that the mechanism is in an unlocked condition. The gaming-table support locking apparatus 907 performs each of these functions while optimizing additional constraints (e.g., materials selection) and minimizing the risk of injury (e.g., pinch point injuries). This makes the gaming-table support locking apparatus 907 ideal for in-home use and particularly ideal for use with basketball game apparatus 900.

Support System for a Gaming Table

Figure 12:
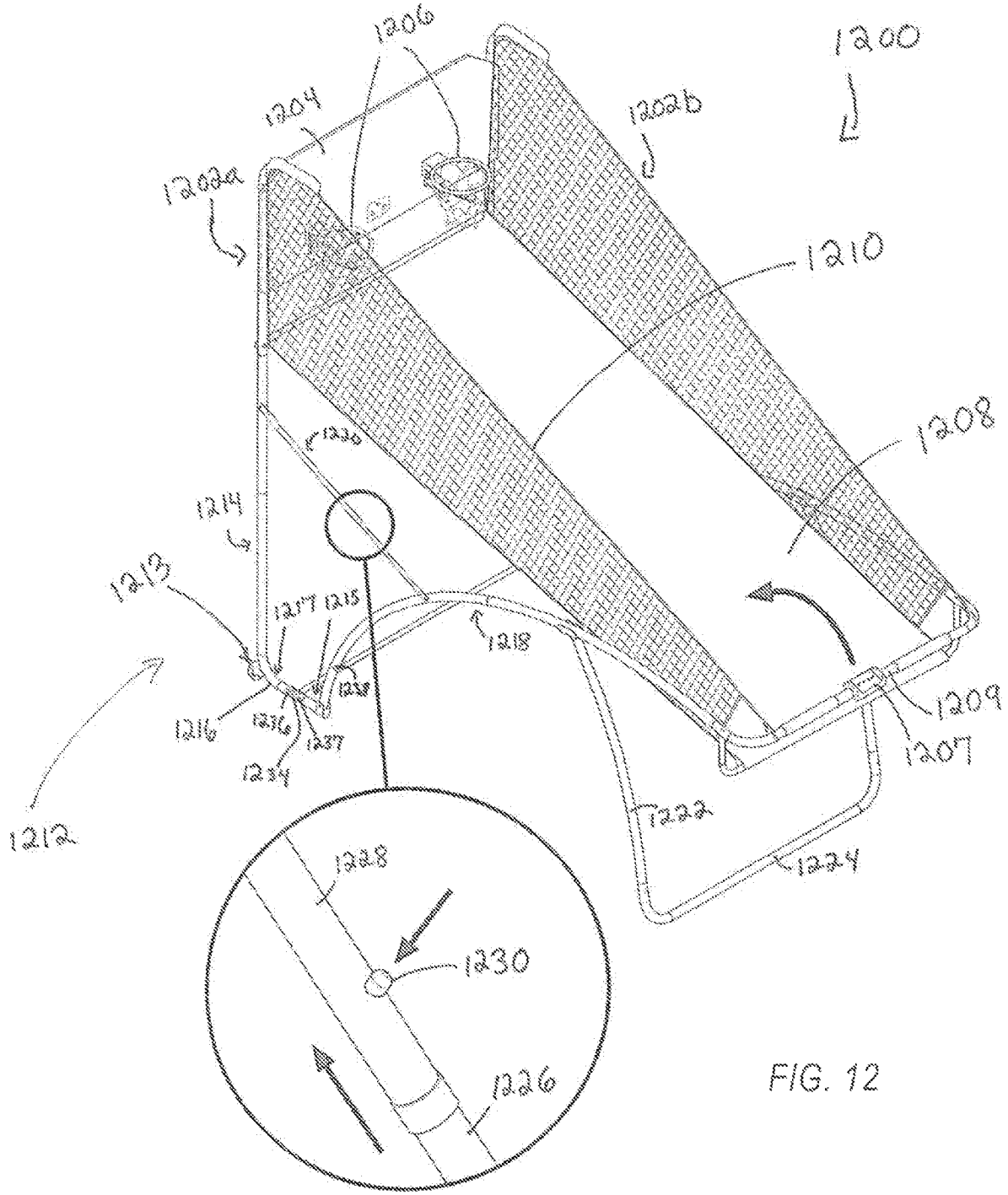
FIG. 12 shows a diagram example of a basketball game apparatus, according to one embodiment of the present disclosure.

FIG. 12 shows an example of a basketball game apparatus 1200 when the basketball game apparatus 1200 is in an opened state (e.g., opened from a collapsed configuration to a playable configuration). The basketball game apparatus 1200 may include side panels 1202*a*, 1202*b*, a backboard 1204, a center return net 1208, and an end bar 1209. The side panels 1202*a*, 1202*b* may be mirror images of one another, such that each of the two side panels 1202*a*, 1202*b* includes the same structure and components. The side panels 1202*a*,

1202*b* may also each include a support structure 1212 and a netting structure 1210 that extends from the backboard 1204 to the end bar 1209.

The backboard 1204 may include additional features such as visual graphics, an electronic scoreboard, a manual scoreboard, a whiteboard or chalkboard, video camera technology, audio technology, speakers, etc. In other example embodiments, the backboard 1204 may be configured for other types of games such as any one of billiards, foosball, bumper billiards, air hockey, table tennis, target toss, pinball soccer, finger football, bowling, chess, checkers, Chinese checkers, backgammon, basketball toss, football toss, bean bag toss, etc. Likewise, an alternate example embodiment, the backboard 1204 may be configured to multi-game options (e.g., 6-in-1 or 20-in-1 gaming-table configurations). In alternate example embodiments, the support structure 1212 may be configured to support these other types of games. In an example embodiment, the backboard 1204 includes at least one basketball rim 1206. Likewise, the basketball rim 1206 may include additional features such as a net, an electronic scoring sensor, a manual scoring sensor, etc. In some examples, the basketball rim 1206 is hinged such that it may fold flat and parallel to the backboard 1204.

The center return net 1208 may be disposed between the two side panels 1202*a*, 1202*b* and extend from the backboard 1204 out toward the end bar 1209. In some examples, the center return net 1208 has a downward slope that extends toward the floor as it extends away from the backboard 1204, allowing the center return net to catch objects (e.g., basketballs) and send them to the user. The end bar 1209 may serve as a stop point for any objects caught by the center return net 1208. For example, once a basketball is caught by the center return net 1208, it rolls downward along the slope of the center return net 1208 until it is stopped by the end bar 1209. The end bar 1209 may include additional features that may interact with the backboard 1204. For example, if the backboard 1204 includes an electronic scoreboard, the end bar 1209 may include a control panel 1207, from which the user may select game-type, number of players, scoring limit, time limit, etc. Communications with the backboard 1204 may be wired and/or wireless.

The support structure 1212 may be configured to support a portion of the basketball game apparatus 1200 above the floor. The support structure 1212 may include a first support bar 1214, a second support bar 1216 attached to the first support bar, a third support bar 1218 attached to the second support bar 1216, a support locking apparatus 1220 attached to the first support bar 1214 and third support bar 1218, a fourth support bar 1222 attached to the third support bar 1218, and a fifth support bar 1224 attached to the fourth support bar 1222. The first support bar 1214 and the third support bar 1218 may support the netting structure 1210 and the backboard 1204. In some examples, the first support bar 1214 may include a wheel 1213. The wheel may be mounded on the first support bar 1214 such that when the basketball game apparatus 1200 is in the opened state, the wheel 1213 does not contact the ground.

The second support bar 1216 may be substantially parallel to the ground and may be substantially perpendicular to the first support bar 1214. The second support bar 1216 may include a proximal portion 1217 and a distal portion 1215. The second support bar 1216 may attach to the third support bar 1218 at the distal portion 1215 of the second support bar 1216. In some examples, the second support bar 1216 is be unitary with the first support bar 1214, and is formed as one part therewith. In other examples, the second support bar 1216 is detachable from the first support bar 1214. Support may be enhanced by implementation of additional bars of the support structure 1212.

In some examples, the second support bar 1216 includes a safety latch 1234 disposed on an outer surface of the second support bar 1216. The safety latch 1234 may be disposed between the proximal portion 1217 and distal portion 1215. The safety latch 1234 may be elongated and in pivotable connection with the second support bar 1216. The safety latch 1234 may include a pin 1236 configured to engage with a window 1238 on the third support bar 1218.

With reference to FIGS. 12-15, in some examples, the third support bar 1218 is arcuate shaped. The third support bar may also have no hinges. The third support bar having an arcuate shape and having no hinges provides various benefits for the support system for the gaming table. For example, a user who is engaging the apparatus in a lock state will not pinch their hand on any hinges. Furthermore, the arcuate shape of the third support bar 1218 allows for more compact shipping because members of the third support bar 1218 can be shipped in two separate pieces. The arcuate shape of the third support bar 1218 also allows for cost reduction in manufacturing because it allows for one less hinge to have to manufactured and assembled onto the support system for the gaming table. Furthermore, the arcuate shape of the third support bar 1218 exhibits greater resistance to kinking, compared to straight support bars, when exposed to various types of loading.

With continued reference to FIG. 12, in an example embodiment, the support locking apparatus 1220 is disposed between and fixed to the first support bar 1214 and the third support bar 1218. In this example, the support locking apparatus 1220 is composed of two bars: a first telescoping bar 1226 and a second telescoping bar 1228, which are telescopically engaged with one another. A first portion of the first telescoping bar 1226 may be rotatably fixed to the first support bar 1214. A first portion of the second telescoping bar 1228 may be rotatably fixed to the third support bar 1218. A second portion of the first telescoping bar 1226 may be telescopically engaged with a second portion of the second telescoping bar 1228. The first telescoping bar 1226 may be at least partially disposed inside the second telescoping bar 1228, such that the first telescoping bar 1226 may slide relative to the second telescoping bar 1228. The support locking apparatus 1220 additionally includes a telescope button 1230. For example, the telescope button 1230 may be an internal push button locking mechanism. In an example embodiment, the telescope button 1230 extends through a window of the support locking apparatus 1220. For example, the telescope button 1230 extends through a window defined by each of the first telescoping bar 1226 and the second telescoping bar 1228.

Through implementation of the telescope button 1230, the support locking apparatus 1220 may be either not engaged (i.e., preventing telescoping) or engaged (i.e., allowing telescoping). For example, when the telescope button 1230 is not engaged, it extends through the window of the support locking apparatus 1220. The first telescoping bar 1226 and the second telescoping bar 1228 are unable to slide (e.g. telescope) relative to one another because the telescope button 1230 extends through the window defined by each of the first telescoping bar 1226 and the second telescoping bar 1228. However, when the telescope button 1230 is engaged by a user, such that it no longer extends through the window of the support locking apparatus 1220, the first telescoping bar 1226 and the second telescoping bar 1228 slide (e.g., telescope) relative to one another. For example, the length of the support locking apparatus 1220 may be telescopically adjustable when the telescope button 1230 is engaged because the first telescoping bar 1226 and the second telescoping bar 1228 are able to slide relative to one another.

Figure 13:
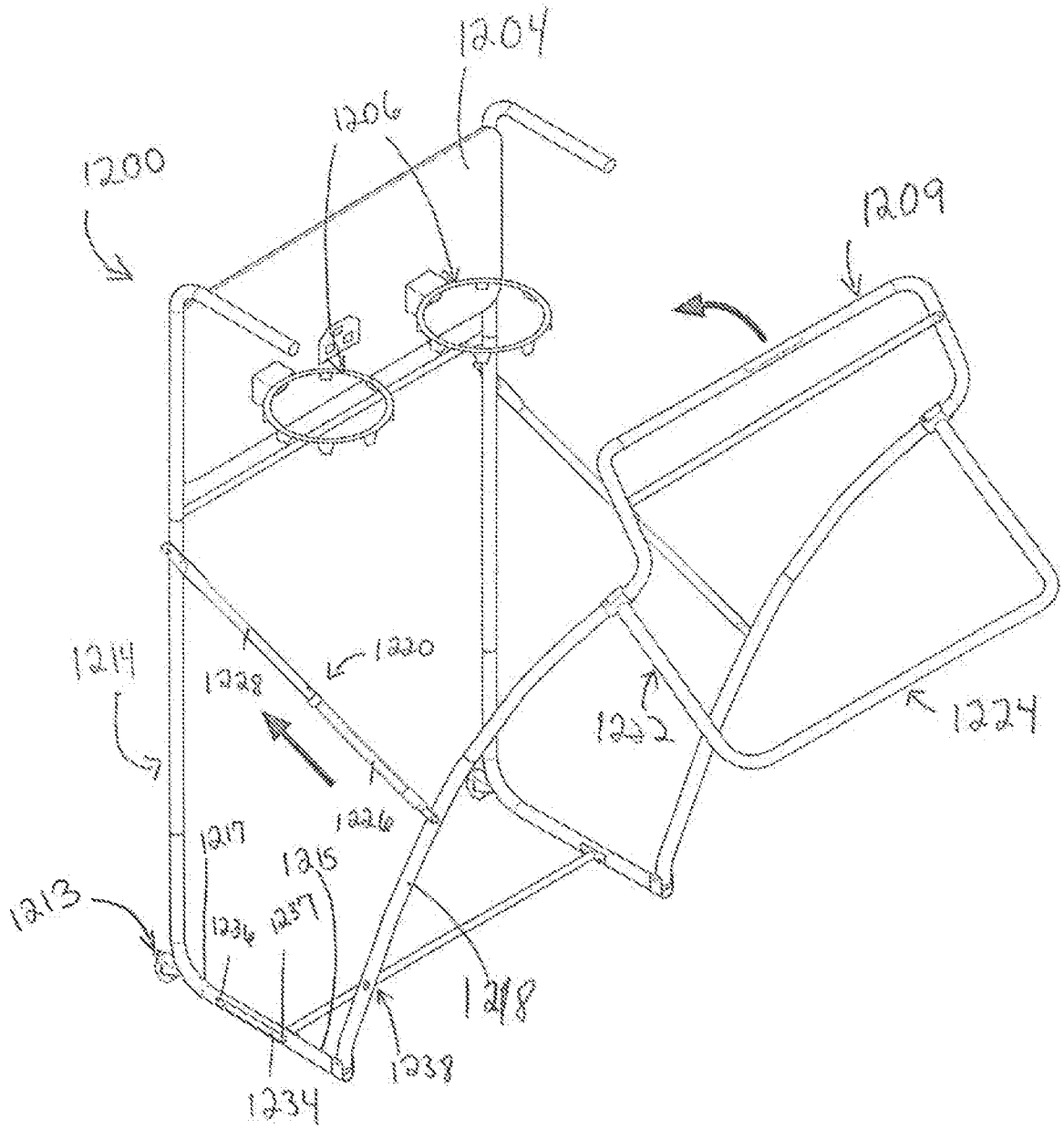
FIG. 13 shows a diagram of a semi-closed example basketball game apparatus, according to one embodiment of the present disclosure.
Figure 14:
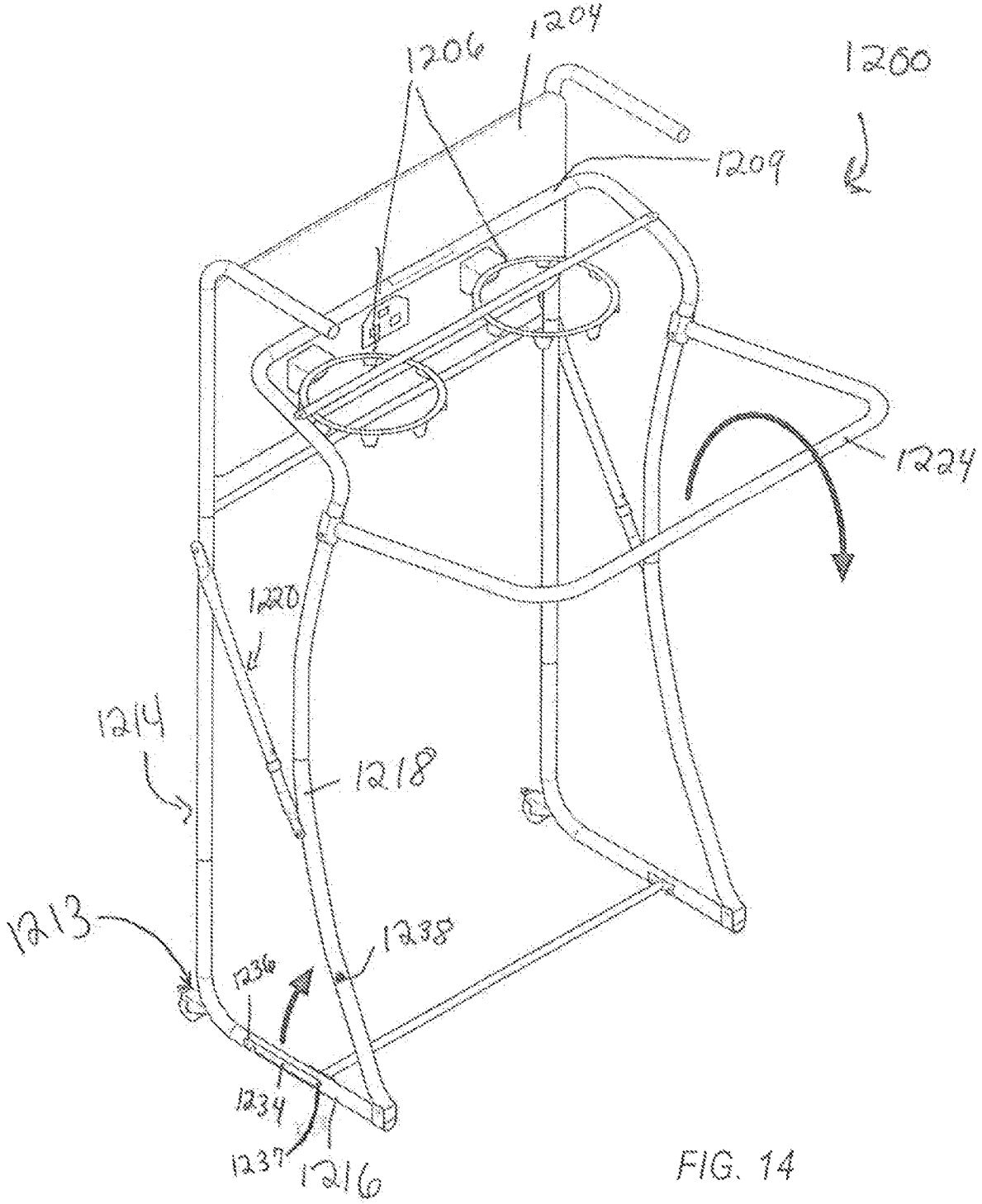
FIG. 14 shows a diagram of a closed example basketball game apparatus, according to one embodiment of the present disclosure.

With reference to FIGS. 12-14, an example embodiment of the basketball game apparatus 1200 is depicted. FIG. 12 depicts the basketball game apparatus 1200 in the opened state. In the example embodiment, the support locking apparatus 1220 may perform a similar function as rotation of the first hinge bar 410 and the second hinge bar 420 by the gaming-table support locking apparatus 107. For example, to close (e.g., collapse) the basketball game apparatus 1200, the third support bar 1218 is rotated to be flat and parallel with the first support bar 1214.

FIG. 13 depicts the basketball game apparatus 1200 in a semi-closed state with netting structure 1210 and center return net 1208 omitted from view. Because the support locking apparatus 1220 is disposed between the first support bar 1214 and the third support bar 1218, the length of the support locking apparatus 1220 may shorten or reduce as the third support bar 1218 is rotated to be flat and parallel with the first support bar 1214. To create this adjustably shortened length, a telescopically adjustable support locking apparatus 1220 may be used.

FIG. 14 depicts the basketball game apparatus 1200 in a closed state with netting structure 1210 and center return net 1208 omitted from view. In an example, as the third support bar 1218 is rotated to be flat and parallel with the first support bar 1214, the first telescoping bar 1226 slides and is disposed within the second telescoping bar 1228, such that the total length of the support locking apparatus 1220 may be shortened or reduced. In this way, a telescopically adjustable support locking apparatus 1220 may facilitate the collapsing and storage of the basketball game apparatus 1200. When the basketball game apparatus 1200 is in the closed state, a user can tilt the basketball game apparatus 1200 in a direction, causing the wheel 1213 to contact the ground. The wheel 1213 in contact with the ground will decrease friction and allow the user to use less of his or her own strength to move the basketball apparatus 1200.

Likewise, when the basketball game apparatus 1200 is opened (e.g., opened from a collapsed configuration to a playable configuration), the third support bar 1218 may be rotated away from the first support bar 1214. Because the support locking apparatus 1220 is disposed between the first support bar 1214 and the third support bar 1218, the length of the support locking apparatus 1220 may extend or increase as the third support bar 1218 is rotated away from the first support bar 1214. To have an extendable length, the first telescoping bar 1226 slides away from the second telescoping bar 1228, such that the total length of the support locking apparatus 1220 may be extended or increased. In this way, a telescopically adjustable support locking apparatus 1220 may facilitate the opening of the basketball game apparatus 1200.

As disclosed herein, the support locking apparatus 1220 is self-contained. It does not require a number of different components that could be lost or misplaced (e.g., a snap clamp with a flexible fitting and two rods or bars). Likewise, for example, the support locking apparatus 1220 is configured to require an ideal force (e.g., the pushing force from one finger of the user) for engagement of the telescope button 1230. The mechanical design of the support locking apparatus 1220 provides for secure connections in both locked and unlocked states. Additionally, for example, the support locking apparatus 1220 provides for visual identification of the condition of the support locking apparatus 1220 (i.e., locked or unlocked). For example, the user may visually identify the telescope button 1230, and thus assume that the support locking apparatus 1220 is in a locked condition; alternatively, if the telescope button 1230 on the support locking apparatus 1220 is not visible, the user may assume that the support locking apparatus 1220 is in an unlocked condition. The support locking apparatus 1220 performs each of these functions while optimizing additional constraints (e.g., materials selection) and minimizing the risk of injury (e.g., pinch point injuries). This makes the support locking apparatus 1220 ideal for in-home use and particularly ideal for use with basketball game apparatus 1200.

Figure 15:
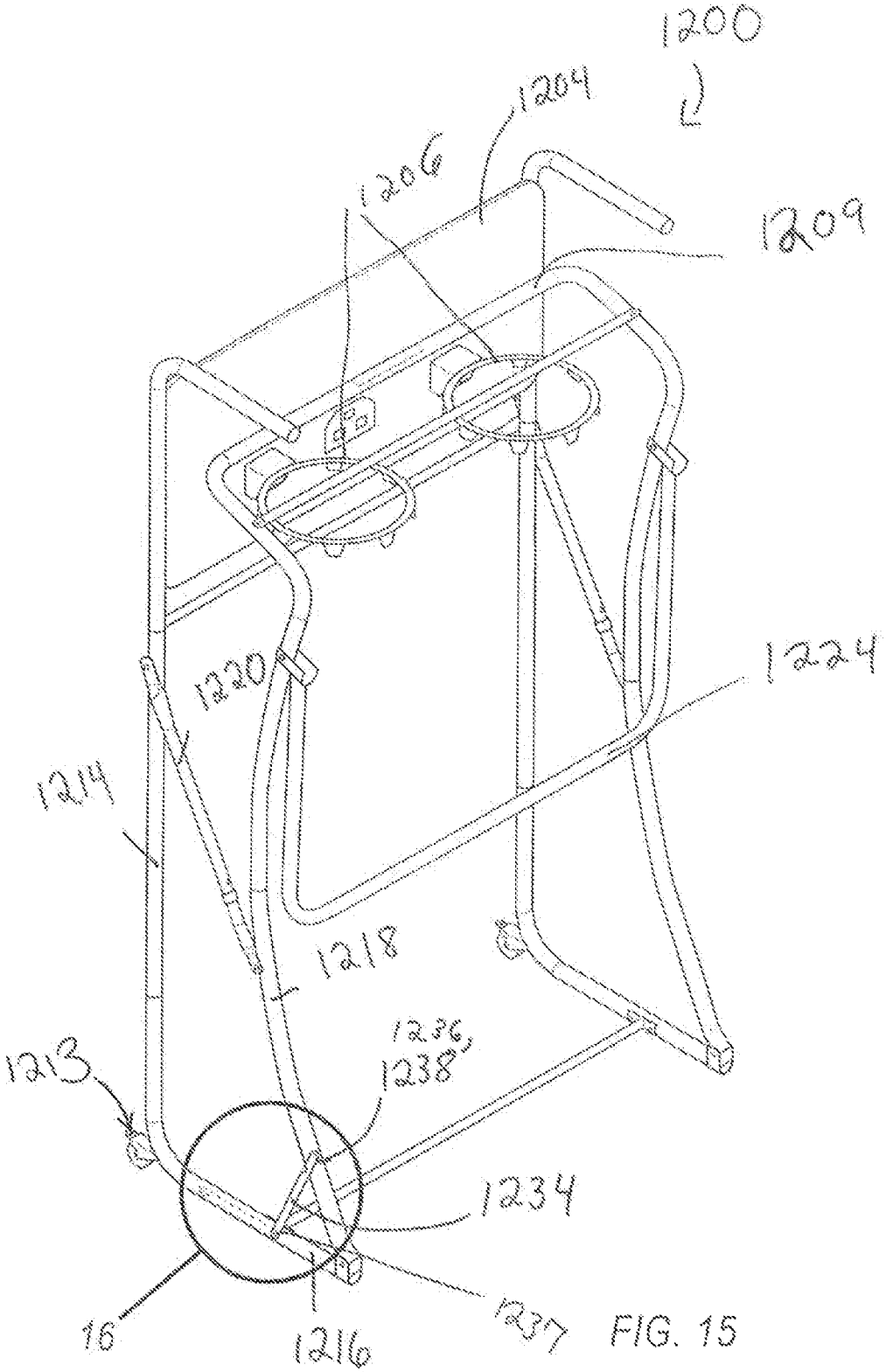
FIG. 15 shows a diagram of a closed example basketball game apparatus, according to one embodiment of the present disclosure.
Figure 16:
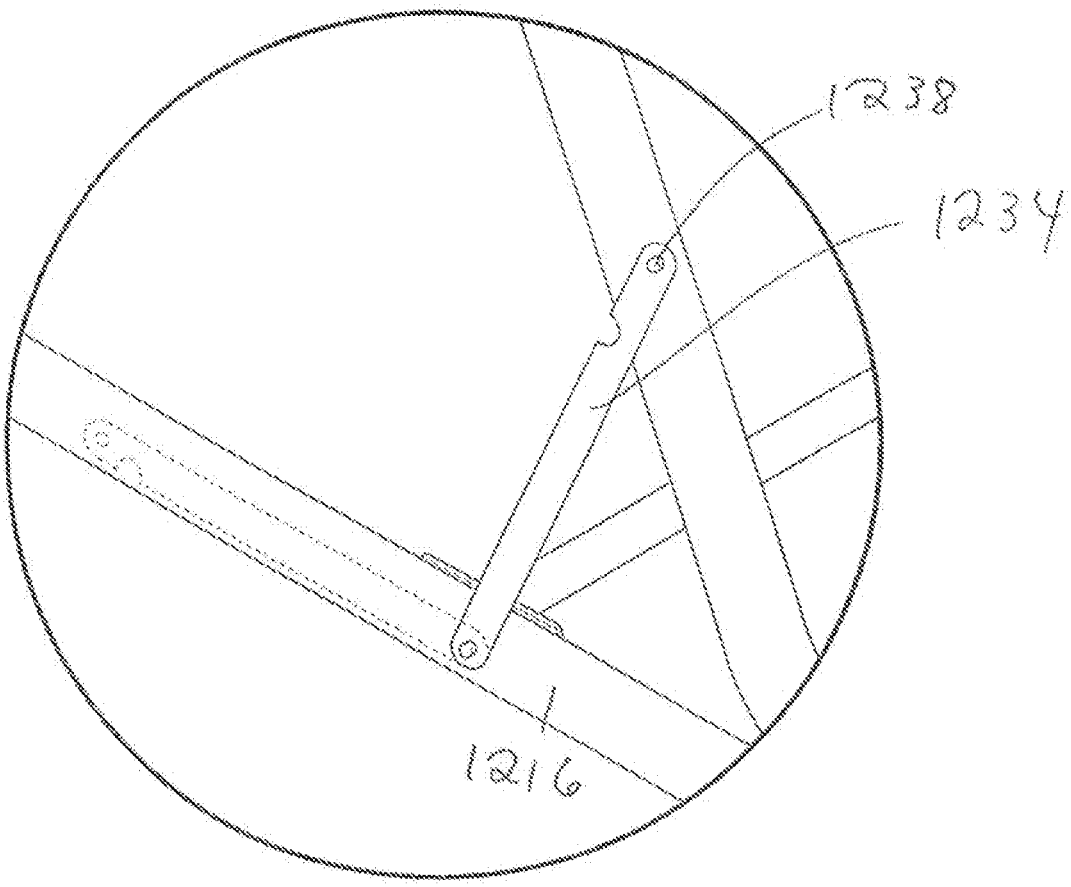
FIG. 16 shows a diagram of a gaming-table support system, according to one embodiment of the present disclosure.

With reference to FIGS. 14-16, an example embodiment of the basketball game apparatus 1200 is depicted. The second support bar 1216 may include the safety latch 1234. The safety latch 1234 may be fastened to the second support bar 1216 by a pivot pin 1237. The safety latch 1234 may be in pivotable connection with the second support bar 1216 and configured to engage the third support bar 1218 by latching onto the window 1238. FIG. 14 depicts the safety latch 1234 in an unengaged safety state. In an example, when the safety latch 1234 is not engaged with the window 1238, the safety latch 1234 is in an unengaged safety state. The safety latch 1234 may be stowed away in a position parallel to the second support bar 1216. When the safety latch is in the unengaged safety state, the third support bar 1218 may pivot freely about the second support bar 1216 via the pivot pin 1237.

As depicted in FIG. 15, in another example, when safety latch 1234 is engaged with the window 1238, the safety latch 1234 is in an engaged safety state. When the safety latch 1234 is in the engaged safety state, the pin 1236 of the safety latch 1234 may be inserted into the window 1238 of the third support bar 1218. The engagement of the pin 1236 into the window 1218 may prevent the third support bar 1218 from pivoting about the second support bar 1216 whether the support locking apparatus 1220 is in the locked condition or the unlocked condition. The safety latch 1234 enhances safety of the basketball game apparatus 1200 because the safety latch 1234 may prevent the third support bar 1218 from pivoting about the second support bar 1216 even when the support locking apparatus 1220 is in the unlocked condition. Therefore, if the safety latch 1234 is in the engaged safety state, the basketball game apparatus 1200 may remain in the closed state even if the support locking apparatus 1220 is in the unlocked condition. The safety latch 1234 minimizes the risk of injury of a support bar of the basketball game apparatus 1200 falling on a user because even if the support locking apparatus 1220 is unintentionally in the unlocked condition, the gaming apparatus 1200 will be prevented from being in the opened state and will therefore not fall on and injure a user.

A number of implementations have been described. Nevertheless, it will be understood that various modifications may be made without departing from the spirit and scope of the disclosure. Accordingly, other implementations are within the scope of the following claims.

Conclusion

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A gaming table apparatus, comprising:

two side support panels, wherein each of the two side support panels comprises:

a first support bar;

a second support bar coupled to the first support bar and substantially perpendicular to the first support bar;

a third support bar coupled to the second support bar, and the third support bar is pivotably coupled to the second support bar; and a locking apparatus coupled to the third support bar and the first support bar, wherein the locking apparatus comprises:

a first locking bar;

a second locking bar coupled to the first locking bar, wherein the second locking bar is configured to be in one of two states of being:

a first state that allows the third support bar to rotate with respect to the second support bar; and a second state that prevents the third support bar from rotating with respect to the second support bar; and the gaming table apparatus further comprises:

a backboard panel coupled to the two side support panels and comprising at least one hinged basketball rim.

2. The gaming table apparatus of claim 1, wherein the second support bar is configured to engage an underlying surface.

3. The gaming table apparatus of claim 1, wherein the third support bar is coupled to a fourth support bar.

4. The gaming table apparatus of claim 1, wherein the first locking bar is telescopically engaged with the second locking bar.

5. The gaming table apparatus of claim 4, wherein the second locking bar defines a window, and the first locking bar comprises a button configured to be in one of two states of being:

a locked state that prevents the first locking bar to move telescopically with the second locking bar, wherein the button in engaged with the window, and wherein the button extends beyond the window; and a freed state that allows the first locking bar to move telescopically with the second locking bar and wherein the button is not engaged with the window.

6. A gaming table apparatus, comprising:

two side support panels, wherein each of the two side support panels comprises:

a first support bar;

a second support bar;

a locking mechanism coupled to at least one of the first and second support bars, the locking mechanism comprises:

a first locking bar; and a second locking bar coupled to the first locking bar, wherein the second locking bar is configured to be in one of two states of being:

a first state that allows the second support bar to rotate with respect to the first support bar; and a second state that prevents the second support bar from rotating with respect to the first support bar; and the gaming table apparatus further comprises:

a backboard panel coupled to the two side support panels;

a cross bar coupled to the two side support panels; and a return net coupled to the two side support panels, the return net comprising a first portion coupled adjacent to the backboard panel and a second portion coupled to the cross bar.

7. The gaming table apparatus of claim 6, wherein the backboard panel comprises at least one rim.

8. The gaming table apparatus of claim 6, wherein the backboard panel comprises a scoreboard.

9. The gaming table apparatus of claim 6, wherein the return net has a downward slope that extends toward the floor as it extends away from the backboard panel.

10. The gaming table apparatus of claim 6, wherein each side support panel comprises a side boundary net.

11. The gaming table apparatus of claim 6, wherein the first locking bar and the second locking bar comprise a rigid material.

12. The gaming table apparatus of claim 11, wherein the rigid material comprises one of a rigid plastic and metal.

13. The gaming table apparatus of claim 6 wherein, when the second locking bar is in the second state, the first locking bar and the second locking bar linearly align with each other.

* * * * *